US009376276B2

(12) United States Patent
Yokoya et al.

(10) Patent No.: US 9,376,276 B2
(45) Date of Patent: Jun. 28, 2016

(54) SHEET FEEDING APPARATUS AND IMAGE FORMING APPARATUS

(71) Applicant: CANON KABUSHIKI KAISHA, Tokyo (JP)

(72) Inventors: Takashi Yokoya, Kashiwa (JP); Satoru Yamamoto, Noda (JP); Toshiyuki Miyake, Abiko (JP); Katsuya Nakama, Nagareyama (JP); Koji Yumoto, Toride (JP); Akinobu Nishikata, Abiko (JP); Kenji Morita, Toride (JP); Riki Fukuhara, Kashiwa (JP); Akihiro Kawakita, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 14/581,751

(22) Filed: Dec. 23, 2014

(65) Prior Publication Data

US 2015/0183595 A1 Jul. 2, 2015

(30) Foreign Application Priority Data

Dec. 26, 2013 (JP) ..... 2013-269662

(51) Int. Cl.

| | |
|---|---|
| ***B65H 1/00*** | (2006.01) |
| ***B65H 1/14*** | (2006.01) |
| ***B65H 7/06*** | (2006.01) |
| ***B65H 1/26*** | (2006.01) |
| ***B65H 3/12*** | (2006.01) |
| ***B65H 3/48*** | (2006.01) |
| *B65H 9/10* | (2006.01) |

(52) U.S. Cl.

CPC ..... *B65H 1/14* (2013.01); *B65H 1/266* (2013.01); *B65H 3/128* (2013.01); *B65H 3/48* (2013.01); *B65H 7/06* (2013.01); *B65H 9/101* (2013.01); *B65H 2220/15* (2013.01); *B65H 2405/112* (2013.01); *B65H 2405/1122* (2013.01); *B65H 2405/11164* (2013.01); *B65H 2405/15* (2013.01); *B65H 2511/20* (2013.01);*B65H2511/518* (2013.01); *B65H 2511/524* (2013.01); *B65H 2551/27* (2013.01); *B65H 2553/612* (2013.01); *B65H 2801/06* (2013.01)

(58) Field of Classification Search

CPC ..... B65H 1/04; B65H 9/101; B65H 2220/15; B65H 2405/112; B65H 2405/1122; B65H 2405/11164

USPC ..... 271/171, 233

See application file for complete search history.

(56) References Cited

U.S. PATENT DOCUMENTS

| | | | | |
|---|---|---|---|---|
| 4,867,436 | A * | 9/1989 | Hanada | B65H 3/0684 271/221 |
| 5,116,036 | A * | 5/1992 | LeRoy | B65H 29/68 271/184 |
| 5,181,706 | A * | 1/1993 | Yamamoto | B65H 3/126 271/104 |

(Continued)

FOREIGN PATENT DOCUMENTS

| | | | |
|---|---|---|---|
| JP | 10-77123 | A | 3/1998 |
| JP | 2012-046279 | A | 3/2012 |

*Primary Examiner* — Howard Sanders

(74) *Attorney, Agent, or Firm* — Canon USA, Inc. IP Division

(57) ABSTRACT

A sheet feeding apparatus includes a containing unit, a lifting and lowering unit, a loosening unit, a feed unit, a sheet-surface detection unit, an aligning member, a trailing-edge detection unit, a double-feed detection unit, and a control unit. Sheets, of a sheet bundle contained in the containing unit and lifted and lowered, are loosened by blowing air into the sheet bundle and fed. An end face of the contained sheet bundle is aligned on a trailing-edge side. The trailing-edge detection unit moves with the aligning member and detects a sheet surface of a top of the sheet bundle on the trailing-edge side. Where double feed from the containing unit is detected, a detection operation detects, in consideration of a trailing-edge detection unit result, whether the aligning member is located at a position at which the end face of the sheet bundle on the trailing-edge side is aligned.

27 Claims, 14 Drawing Sheets

(56) References Cited

U.S. PATENT DOCUMENTS 5,645,274 A * 7/1997 Ubayashi ..... B65H 1/14 271/104
7,744,081 B2 * 6/2010 Ikeda ..... B65H 1/14 271/265.01
7,976,011 B2 * 7/2011 Shibuya ..... B65H 3/06 271/9.02
8,439,349 B2 * 5/2013 Matsumoto ..... B65H 3/128 371/108
2006/0288893 A1 * 12/2006 Ikeda ..... B65H 1/04 101/407.1

* cited by examiner

SHEET FEEDING APPARATUS AND IMAGE FORMING APPARATUS

BACKGROUND OF THE INVENTION

1. Field of the Invention

The present invention relates to a sheet feeding apparatus that performs sheet feed in such a manner as to separate sheets one by one from a bundle of sheets stacked in a sheet container and relates to an image forming apparatus including the sheet feeding apparatus.

2. Description of the Related Art

According to the related art, there are widely available sheet feeding apparatuses in image forming systems such as printers, copiers, and fax machines, the sheet feeding apparatuses feeding sheets in such a manner as to separate sheets one by one from a bundle of sheets stacked in a sheet container.

In addition, with the increase in user's needs in recent years, the demand has been increasing for feeding sheets of various sizes.

Japanese Patent Laid-Open No. 10-77123 proposes a sheet cassette that prevents occurrence of double feed, misfeeding, and the like in such a manner as to align leading edges, in the conveying direction, of sheets loaded in the sheet cassette with one another regardless of the size of the sheets and to keep constant a press-contact force applied to feed rollers. Specifically, the sheet cassette includes trailing-edge guides that align the trailing edges of the sheets in the sheet cassette and that have different heights so as to match respective different sheet sizes of stacked sheets.

In the sheet cassette described in Japanese Patent Laid-Open No. 10-77123, a user adjusts the position of each trailing-edge guide for aligning the trailing edges of the sheets; however, the position of the trailing-edge guide might not be adjusted properly.

A conceivable way of determining whether the trailing-edge guide is properly located is, for example, providing a trailing-edge detection member and a sensor for the trailing-edge guide. FIGS. 2A and 2B illustrate a specific configuration.

The sheet feeding apparatus in FIGS. 2A and 2B includes a vacuum separate/feed mechanism using air to suck and feed sheets. The sheet feeding apparatus also provides a system for determining whether the position of a trailing-edge guide is properly adjusted (hereinafter, referred to as trailing-edge rough-setting detection).

Details regarding the control of the trailing-edge rough-setting detection will be described later. In a case where trailing-edge rough-setting detection is performed, a trailing edge of a top sheet P that has not been fed completely might be up in the air while the leading edge of the top sheet P is held in a paper feed path, as illustrated in FIG. 3C. At this time, a sheet-surface detection sensor 525 incorrectly detects the top sheet P entering the paper feed path as a sheet located uppermost among sheets stacked as a sheet bundle 501. In reality, the sheet bundle 501 is located lower than the top sheet P, and thus a trailing-edge detection member 160 is not in contact with the sheet bundle 501. For this reason, in such a state as in FIG. 3C, the sheet feeding apparatus determines that a trailing-edge guide 504 has not been properly placed, even though the trailing-edge guide 504 has been properly placed against the sheet bundle 501.

As described above, in a case where a sheet feeding apparatus has both a vacuum separation mechanism and a system automatically performing the trailing-edge rough-setting detection, the sheet feeding apparatus might incorrectly detect the position of a trailing-edge guide in the determination of whether the position is properly adjusted.

SUMMARY OF THE INVENTION

The present invention provides a sheet feeding apparatus and an image forming apparatus enabled to prevent false detection in determination of improper placement of a trailing-edge guide.

According to an aspect of the present invention, a sheet feeding apparatus includes a containing unit that contains a sheet bundle formed of a plurality of sheets, a lifting and lowering unit that lifts and lowers the sheet bundle contained in the containing unit, a loosening unit that loosens the plurality of sheets of the sheet bundle contained in the containing unit by blowing air into the sheet bundle, a feed unit that feeds sheets loosened by the loosening unit, a sheet-surface detection unit that detects a sheet surface of a top of the sheet bundle contained in the containing unit, an aligning member that is movable to align an end face of the sheet bundle contained in the containing unit on a trailing-edge side in a direction of feeding performed by the feed unit, a trailing-edge detection unit that moves together with the aligning member and that detects a sheet surface of the top of the sheet bundle on the trailing-edge side, a double-feed detection unit that detects occurrence of double feed in which two or more sheets are fed in an overlapping manner by the feed unit, and a control unit that performs control in which, in a case where the double-feed detection unit does not detect double feed from the containing unit, a detection operation is not executed on the containing unit, and in which, in a case where the double-feed detection unit detects double feed from the containing unit, the detection operation is executed on the containing unit such that, as part of performing the detection operation, the detection operation detects whether the aligning member is located at a position at which the end face of the sheet bundle on the trailing-edge side is aligned, wherein the detection operation is performed in consideration of a result of detection performed by the trailing-edge detection unit when the sheet bundle lifted by the lifting and lowering unit reaches a position at which the sheet surface is detected by the sheet-surface detection unit.

Further features of the present invention will become apparent from the following description of exemplary embodiments with reference to the attached drawings.

DESCRIPTION OF THE EMBODIMENTS

First Embodiment

Hereinafter, embodiments of the present invention will be described with reference to the drawings.

Overall Configuration

Figure 1:
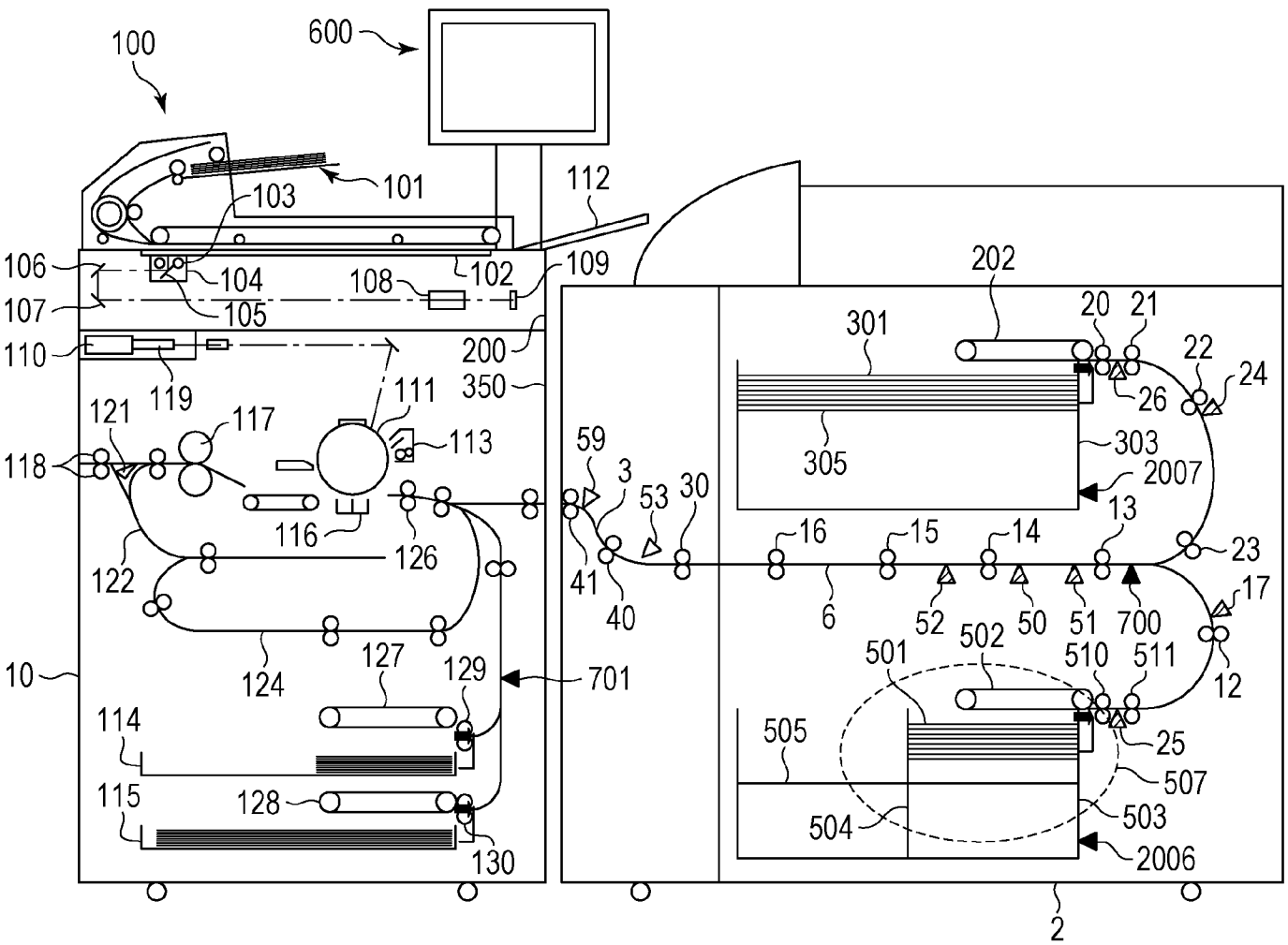
FIG. 1 is a cross-sectional view of an image forming system.

FIG. 1 is a vertical cross-sectional view illustrating a structure of chief portions of an image forming system according to a first embodiment of the present invention. As illustrated in FIG. 1, the image forming system includes an image forming apparatus 10 and a sheet feeding apparatus 2. The image forming apparatus 10 includes an image reader 200 that reads an image of a document and a printer 350 that prints the read image on a sheet.

A document feeder 100 feeds documents one by one from the first page in the left direction in FIG. 1, the documents being placed with image surfaces faceup in a document tray 101. Each document passes through a curved path, over a platen glass 102 from the left, and through a predetermined reading position, and is discharged to a discharge tray 112. While the document is passing over the platen glass 102 from the left to the right, a scanner unit 104 held at the position corresponding to the predetermined reading position reads the document image. When the document passes the reading position, the document is irradiated with light from a lamp 103 of the scanner unit 104. The light reflected on the document is directed to a lens 108 by being reflected on mirrors 105, 106, and 107. The light passing through the lens 108 is used to form an image on an imaging surface of an image sensor 109.

As described above, the documents are scanned and read while being conveyed in such a manner as to pass the reading position from the left to the right. In the document reading scan, a direction orthogonal to a direction in which each document is conveyed is a main scanning direction, and the conveying direction is a sub-scanning direction. Specifically, a whole document image is read in the following manner. While the document is being conveyed in the sub-scanning direction, the image sensor 109 reads the document image on a line basis in the main scanning direction at the reading position where the document passes. The image read in the optical manner is converted into image data, and the image data is outputted by the image sensor 109. The image data outputted from the image sensor 109 is inputted as a video signal to an exposure unit 110 of the printer 350. Note that a document may also be read in the following manner. Specifically, the document is conveyed to the platen glass 102 by the document feeder 100 and is stopped at a predetermined position. In this state, the scanner unit 104 scans the document from the left to the light to thereby read the document.

The exposure unit 110 of the printer 350 modulates a laser beam on the basis of the video signal inputted from the image reader 200 and outputs the laser beam. The laser beam is emitted onto a photoconductor drum 111 scanned by using a polygon mirror 119. An electrostatic latent image is formed on the photoconductor drum 111 in accordance with the scanning with the laser beam. The electrostatic latent image on the photoconductor drum 111 is changed into a visible image as a developed image by using a developer supplied from a developing device 113.

Meanwhile, a sheet fed from an upper cassette 114 or a lower cassette 115 provided in the printer 350 by a suction belt 127 or 128 is conveyed to a registration roller 126 by a drawing roller 129 or 130. At this time, a double-feed detection sensor 701 detects the presence or absence of so-called double feed in which two or more overlapping sheets are fed at the same time.

After the leading edge of the sheet reaches a registration roller 126 that is in a stopped state, the registration roller 126 is driven in synchronization with the start of the laser beam emission. Then, the sheet is conveyed to a portion between the photoconductor drum 111 and a transfer unit 116. The developed image formed on the photoconductor drum 111 is transferred onto the fed sheet by the transfer unit 116. The sheet having the developed image transferred on the sheet is conveyed to a fixing unit 117. The fixing unit 117 fixes the developed image on the sheet by heating and pressing the sheet. The sheet having passed through the fixing unit 117 passes through a flapper 121 and a discharge roller 118, and is discharged from the printer 350 to the outside of the image forming apparatus 10.

Overall System Block Diagram

Figure 4:
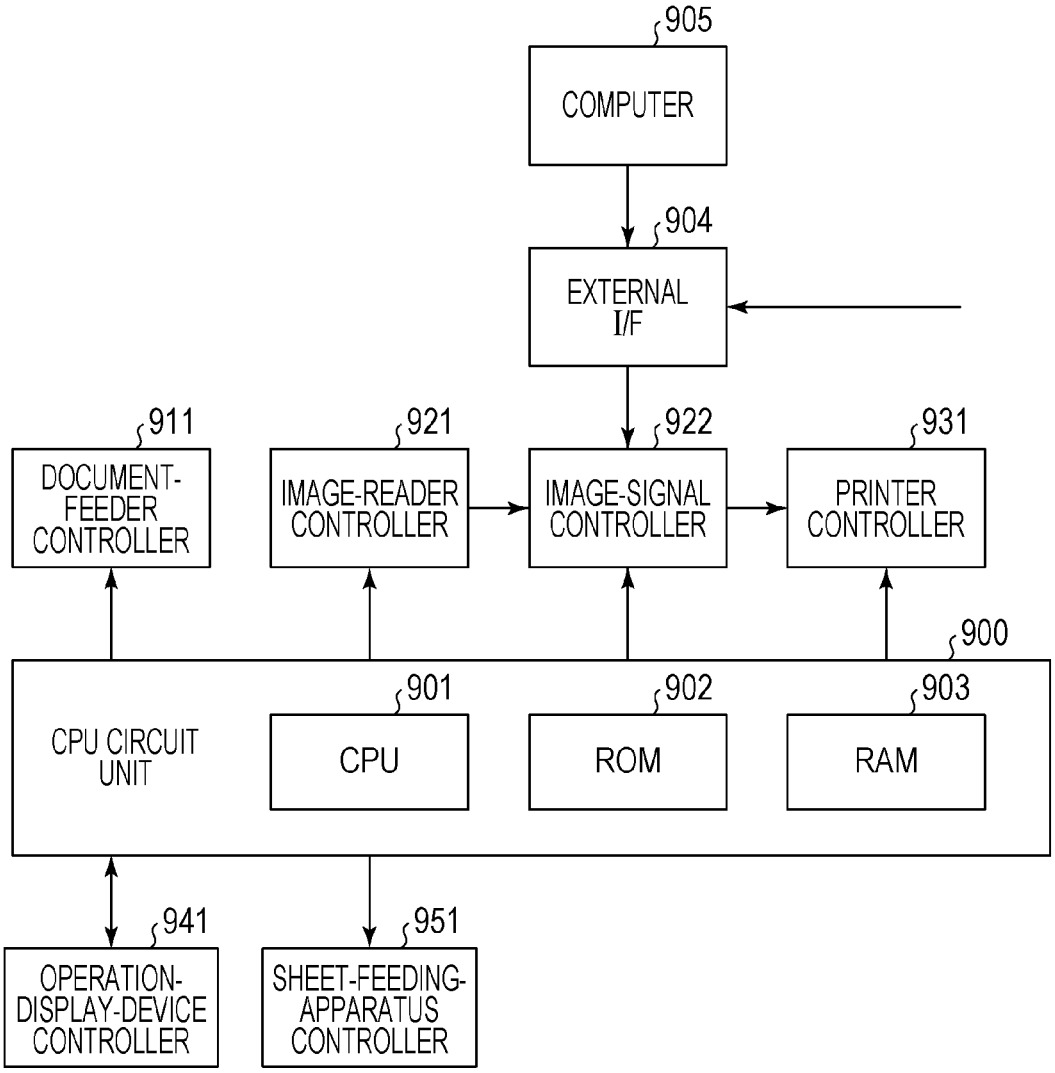
FIG. 4 is a control block diagram of the image forming system.

FIG. 4 is an overall control block diagram of the image forming system in FIG. 1.

A central processing unit (CPU) circuit unit 900 includes a CPU 901, a read only memory (ROM) 902, and a random access memory (RAM) 903. The CPU 901 performs basic control on the whole image forming system. The ROM 902 to which a control program is written and the RAM 903 for performing processing are connected to the CPU 901 via an address bus and a data bus. In accordance with the control program stored in the ROM 902, the CPU 901 comprehensively controls a document-feeder controller 911, an image-reader controller 921, an image-signal controller 922, an external interface (I/F) 904, a printer controller 931, an operation-display-device controller 941, and a sheet-feeding-apparatus controller 951. The RAM 903 is used to temporarily store the control data and used as a work area for an arithmetic operation involved in the control.

The document-feeder controller 911 controls driving of the document feeder 100 on the basis of instructions from the CPU circuit unit 900. The image-reader controller 921 controls driving of the scanner unit 104, the image sensor 109, and the like, and transfers the image signal outputted from the image sensor 109 to the image-signal controller 922.

The image-signal controller 922 converts the analog image signal received from the image sensor 109 into a digital signal, performs processing operations on the digital signal, converts the digital signal into a video signal, and outputs the video signal to the printer controller 931. The image-signal controller 922 also performs various processing operations on a digital image signal inputted from a computer 905 through the external I/F 904, converts the digital image signal into a video signal, and outputs the video signal to the printer controller 931. The processing operations performed by the image-signal controller 922 are controlled by the CPU circuit unit 900. The printer controller 931 controls the exposure unit 110 and the printer 350 on the basis of the received video signal to form an image and convey a sheet.

The sheet-feeding-apparatus controller 951 controls driving of the whole sheet feeding apparatus 2 by exchanging information with the CPU circuit unit 900. Details regarding the control will be described later.

The operation-display-device controller 941 exchanges information with an operation display device 600 and the CPU circuit unit 900. The operation display device 600 has a plurality of keys used for setting various functions related to the image forming, a display for displaying information indicating a setting state, and other components. The operation-display-device controller 941 outputs, to the CPU circuit unit 900, key signals corresponding to operations performed through the respective keys, and causes the operation display device 600 to display information corresponding to a signal outputted from the CPU circuit unit 900.

Operation Display Device

Figure 6:
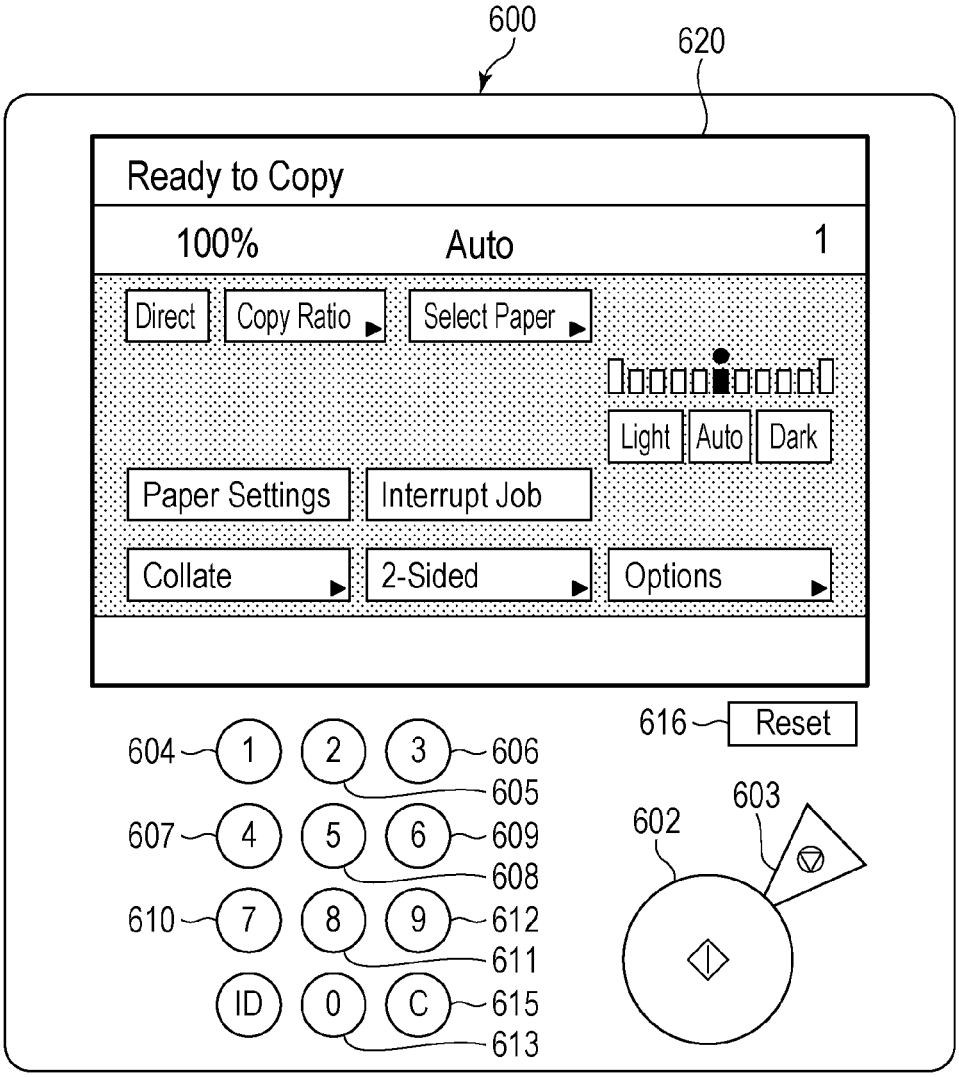
FIG. 6 is an explanatory view of an operation display device.

FIG. 6 illustrates the operation display device 600 of the image forming apparatus 10 in FIG. 1. The operation display device 600 is provided with a start key 602 for starting an image forming operation, a stop key 603 for interrupting the image forming operation, keys 604, 605, 606, 607, 608, 609, 610, 611, 612, and 613 for setting numbers, and a clear key 615 for changing the number back to 1. The operation display device 600 further has a reset key 616 for changing a set operation mode back to an operation mode originally set, and the like that are arranged on the operation display device 600. A display unit 620 having a touch panel is arranged in an upper portion of the operation display device 600, thus enabling soft-keys to be placed on the screen.

Sheet Feeding Apparatus

A configuration of the sheet feeding apparatus 2 will be described with reference to FIG. 1. The sheet feeding apparatus 2 includes a sheet container 503 containing the sheet bundle 501. The sheet container 503 is provided with the trailing-edge guide 504 on the trailing edge side of the sheet bundle 501 in the conveying direction. The trailing-edge guide 504 is manually moved so as to match the size of the sheet bundle 501. When the trailing-edge guide 504 is brought into contact with an end face of the sheet bundle 501 on the trailing edge side, the position of the sheet bundle 501 is thereby aligned so that the leading edge side of the sheet bundle 501 can be aligned with the leading edge side of the sheet container 503 in a feeding direction. A lifter 505 is a member for lifting and lowering the sheet bundle 501 loaded in the sheet container 503. The sheet container 503 includes a lower-limit sensor 2006 at the lowermost position to which the lifter 505 can be lowered. When the lower-limit sensor 2006 detects the lifter 505, the lifter 505 stops lowering.

A vacuum separate/feed mechanism using air to feed sheets will be described with reference to FIGS. 2A and 2B, FIGS. 3A, 3B, and 3C, and FIG. 5.

Figure 3A:
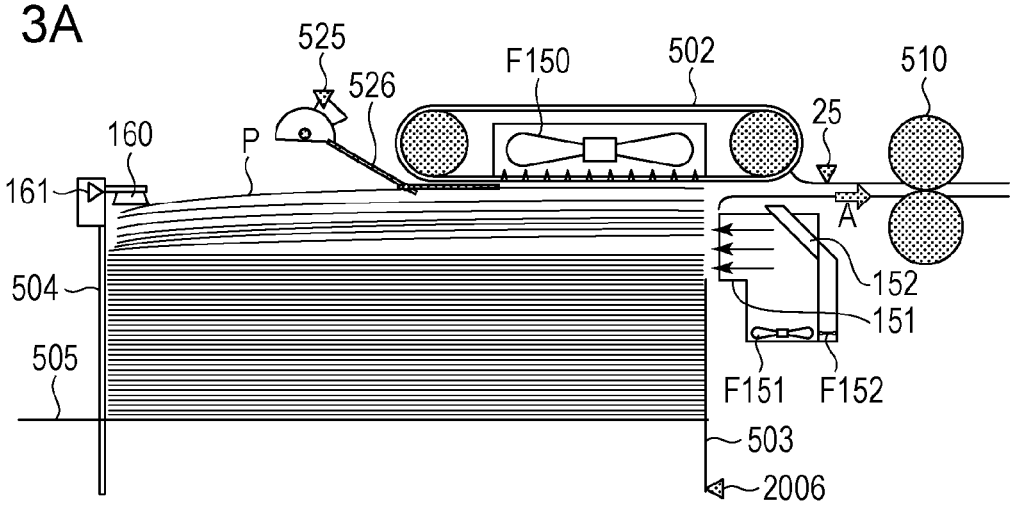
FIGS. 3A, 3B, and 3C are explanatory views of a vacuum separation mechanism.

A separating/feeding unit 507 performs a preparatory feed operation. In the preparatory feed operation, a loosening fan F151 rotates to cause air to be blown from a loosening nozzle 151, and thereby sheets in an upper portion of the sheet bundle 501 start to be loosened. When a sheet feed operation is actually started, a suction fan F150 inward of a suction belt 502 generates a negative pressure, that is, a suction force in a space defined by the suction belt 502, so that a sheet starts to be sucked. In this state, only the top sheet P that is the uppermost sheet in the sheet bundle 501 is attached to the suction belt 502 (FIG. 3A). After the elapse of a predetermined time, a suction belt motor M202 starts rotating the suction belt 502 with the top sheet P attached to the suction belt 502. Then, the top sheet P is conveyed in the direction indicated by an arrow A. When the leading edge of the top sheet P reaches a belt pulley portion, the leading edge portion of the top sheet P is released from the suction force generated by the suction fan F150, separated from the suction belt 502, and then delivered to a drawing roller pair 510. When the leading edge of the top sheet P in the sheet container 503 reaches the drawing roller pair 510, the negative pressure generated by the suction fan F150 is released. The top sheet P is thereby released from the suction force from the suction belt 502, and is conveyed by only a conveyance force generated by the drawing roller pair 510. A predetermined time after the trailing edge of the top sheet P exits the suction belt portion, the feed operation described above is started, and a subsequent sheet starts to be separated and is fed.

Note that the driving of the loosening fan F151 as the preparatory feed operation is started before a feed start signal is sent, but control may be performed to operate the loosening fan F151 immediately before the sheets are fed.

A sheet container 303 also performs the same feed operation as described above. Incidentally, sheet information such as size, material, and basis weight of sheets to be loaded in the sheet containers 503 and 303 can be set through the operation display device 600 in FIG. 6.

Sheet-feeding-apparatus Controller

Figure 5:
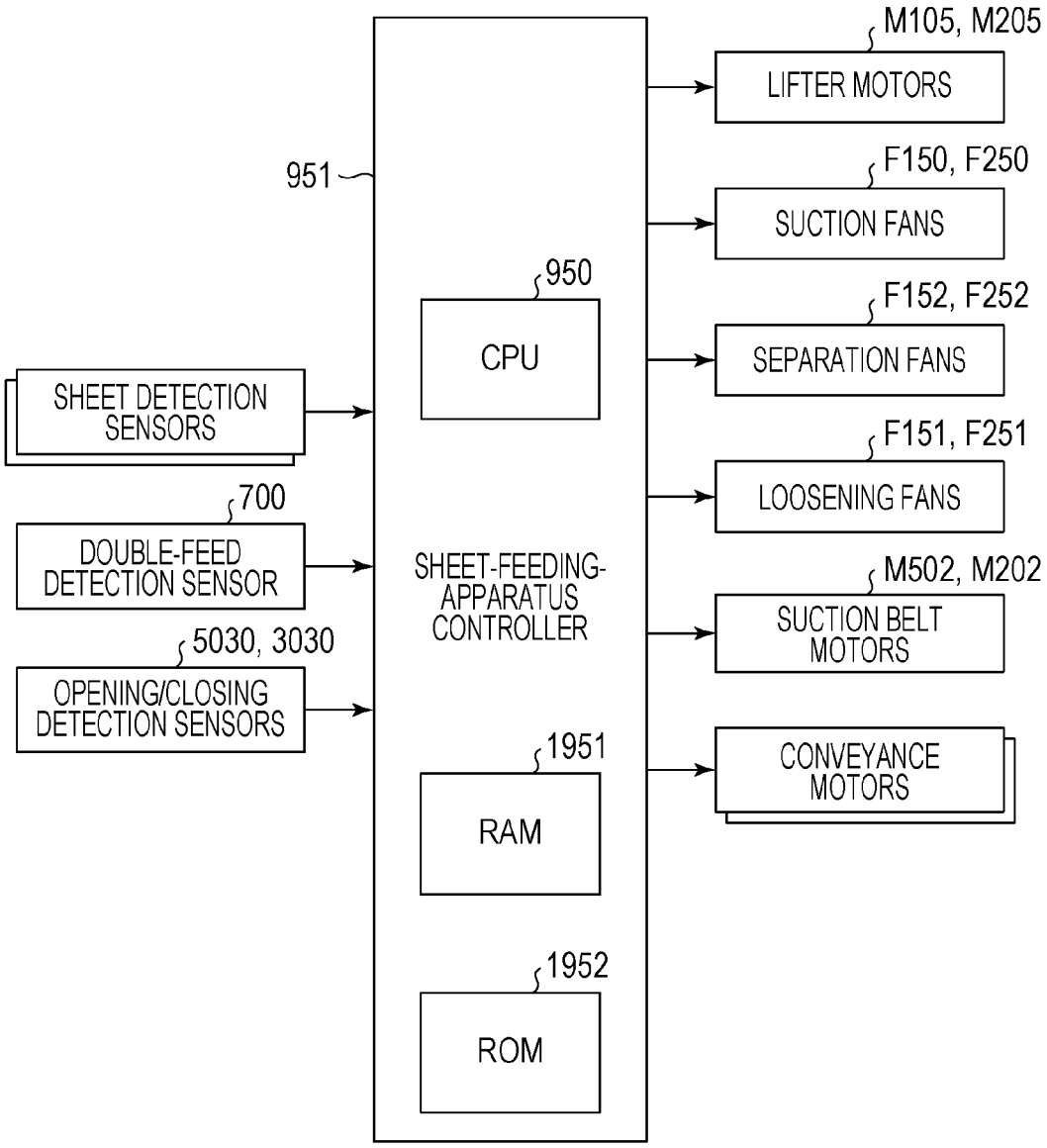
FIG. 5 is a control block diagram of a sheet feeding apparatus.

FIG. 5 is a control block diagram illustrating a configuration of the sheet-feeding-apparatus controller 951. The sheet-feeding-apparatus controller 951 includes a CPU 950, a RAM 1951, and a ROM 1952. The sheet-feeding-apparatus controller 951 controls driving of lifter motors M105 and M205 for lifting and lowering lifters 503 and 505, suction fans F150 and F250, separation fans F152 and F252, and loosening fans F151 and F251. The sheet-feeding-apparatus controller 951 also controls driving of suction belt motors M202 and M502 for driving belts 302 and 502 and conveyance motors for driving conveyance rollers, on the basis of signals from sheet detection sensors.

A double-feed detection sensor 700 detects a state in which two or more sheets fed from the sheet containers 503 and 303 overlap with each other, that is, so-called double feed.

The sheet containers 503 and 303 each include an opening button (not illustrated) for opening a door for accessing inner components. When the opening button is pressed, the door of a corresponding one of the sheet containers 503 and 303 is opened to enable a user to refill the sheet container 503 or 303 with sheets.

The sheet containers 503 and 303 also include opening/closing detection sensors 5030 and 3030 that detect open and closed states of the doors of the sheet containers 503 and 303.

Setting Sheet Information and Jobs

If the user places sheets in a sheet container, information on the sheets needs to be registered. How to set sheet information on size, material, basis weight, and the like of sheets to be loaded in the sheet containers 503 and 303 will be described with reference to FIGS. 6, 7A, 7B, 7C, and 7D.

Figure 7A:
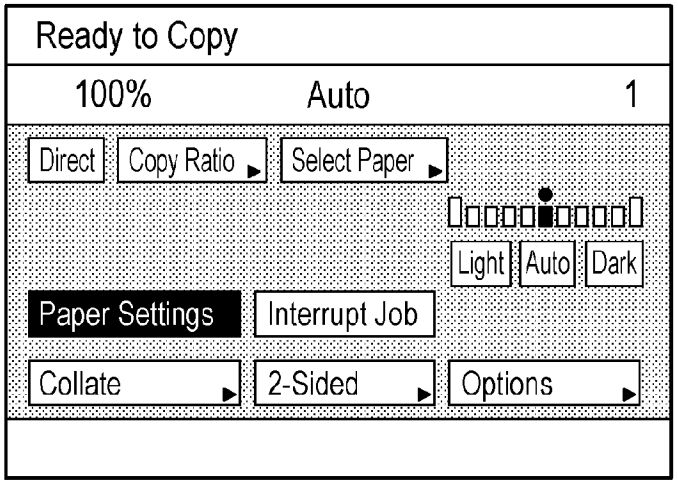
FIGS. 7A, 7B, 7C, and 7D are explanatory views of a job setting screen.
Figure 7B:
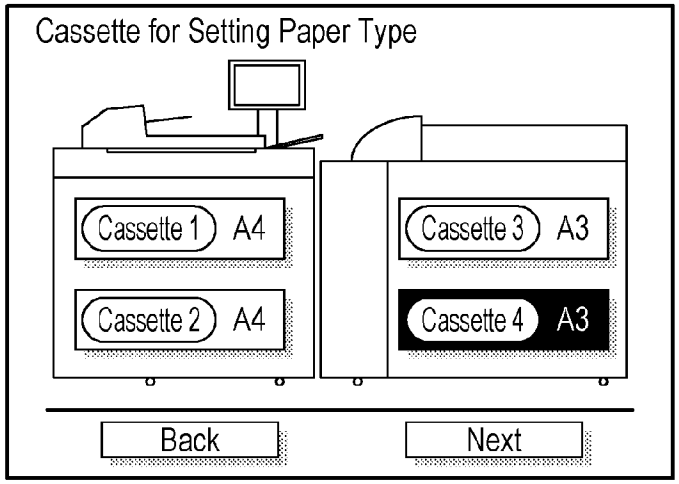
Figure 7C:
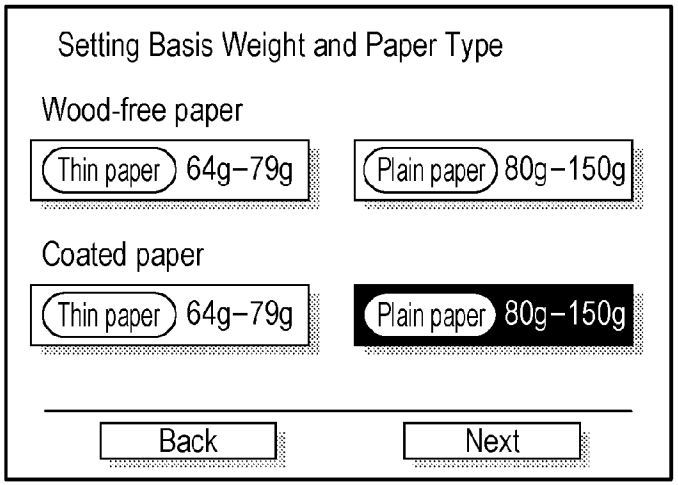
Figure 7D:
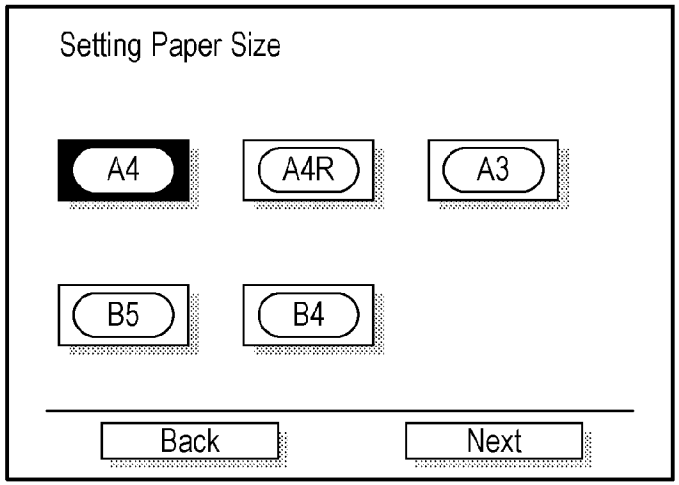

When the user presses the "Paper Settings" button on the display unit 620 in FIG. 6, the CPU 901 causes the setting screen in FIG. 7B to be displayed. The user firstly selects a sheet container for which sheet information is to be set. In this case, the user selects a sheet container from the two sheet containers provided in the image forming apparatus 10 and the two sheet containers provided in the sheet feeding apparatus 2, that is, from a total of four containers. Here, the user selects one of the sheet containers and presses the "Next" button, and then the CPU 901 causes a setting screen illustrated in FIG. 7C for setting a basis weight and a material to be displayed. When the user selects a basis weight and a material of the sheets and presses the "Next" button, the CPU 901 causes a size setting screen illustrated in FIG. 7D to be displayed. When the user selects a sheet size and presses the "Next" button, the current screen is changed to the initial screen in FIG. 7A, and an operation of registering the sheet information is completed.

A job setting flow will be described with reference to FIGS. 6, 8A, 8B, 8C, and 8D. When the user presses the "Select Paper" button on the display unit 620 in FIG. 6, the CPU 901 causes a selection screen illustrated in FIG. 8B to be displayed. When the user selects a sheet container to be used for the job and presses the "Next" button, the initial screen in FIG. 8A appears, and the sheet selection is completed. The user designates the number of output copies in the job by using the keys 604 to 612 on the operation display device 600 and finally presses the start key 602, and thereby the job is started.

The description has been given of a method for setting one sheet container for one job, and a description will be given of a method for setting two or more sheet containers for one job.

Figure 8A:
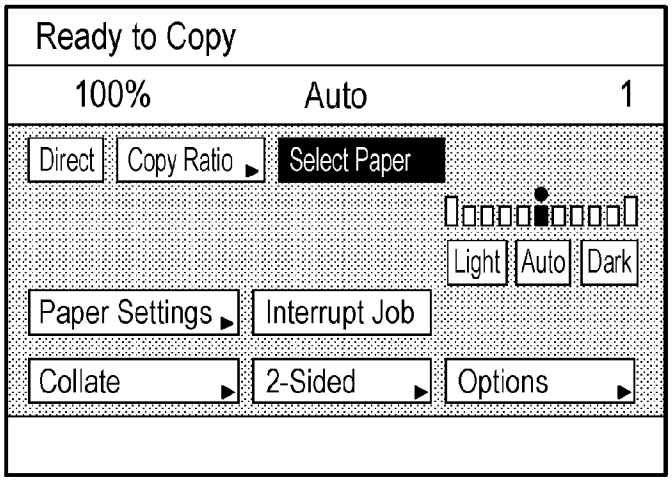
FIGS. 8A, 8B, 8C, and 8D are explanatory views of the setting screen in a case of using a plurality of sheet containers.
Figure 8B:
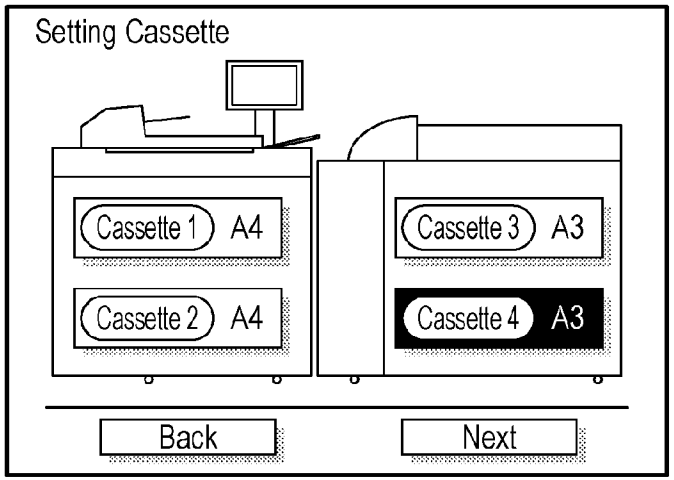
Figure 8C:
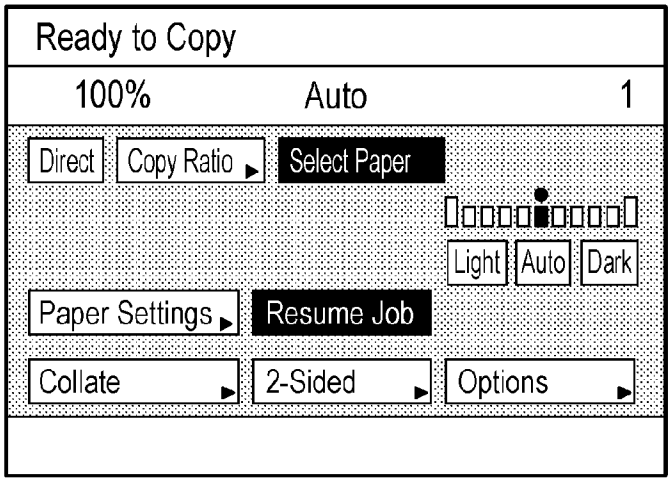
Figure 8D:
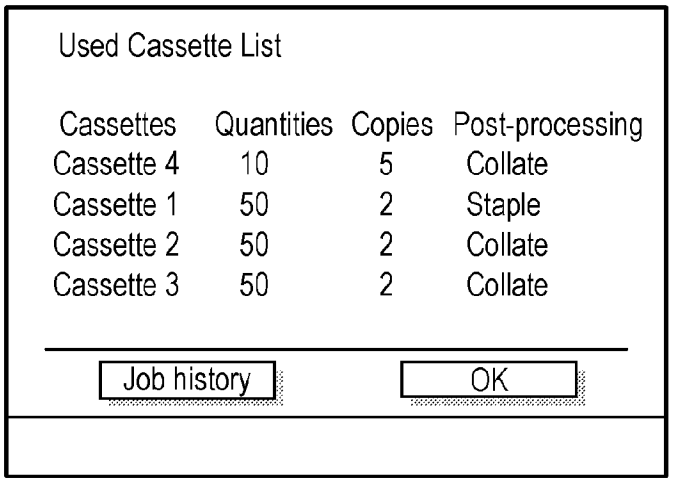

When the "Interrupt Job" button on the display unit 620 illustrated in FIG. 6 is pressed, the display screen is changed to a screen displaying the "Resume Job" button as illustrated in FIG. 8C. In this state, the user can set a job using a plurality of sheet containers. When the user sets sheet containers to be used for the job and the number of output copies in the job and presses the start key 602, jobs for respective sheet containers thus set are accumulated, without being started, in a list of used sheet-feeding-cassettes as illustrated in FIG. 8D. After registration of the jobs for the respective plurality of sheet containers is completed, the user presses the "Resume Job" button in FIG. 8C. Then, the jobs for the respective sheet containers registered in the list of used sheet-feeding-cassettes are serially processed, being regarded as a single job.

Trailing-Edge Rough-Setting Detection Operation

An outline of the rough-setting detection of the trailing-edge guide 504 will be described by using FIGS. 2A and 2B. As described above, the trailing-edge guide 504 needs to be placed at an appropriate position in accordance with the size of the loaded sheets. However, the trailing-edge guide 504 is manually positioned and thus might not be placed at the proper position. Hence, detection of the position of the trailing-edge guide 504 is executed, the detection detecting whether the trailing-edge guide 504 is placed at the appropriate position (hereinafter, the detection is referred to as trailing-edge rough-setting detection). The trailing-edge rough-setting detection operation will be described below.

Figure 2A:
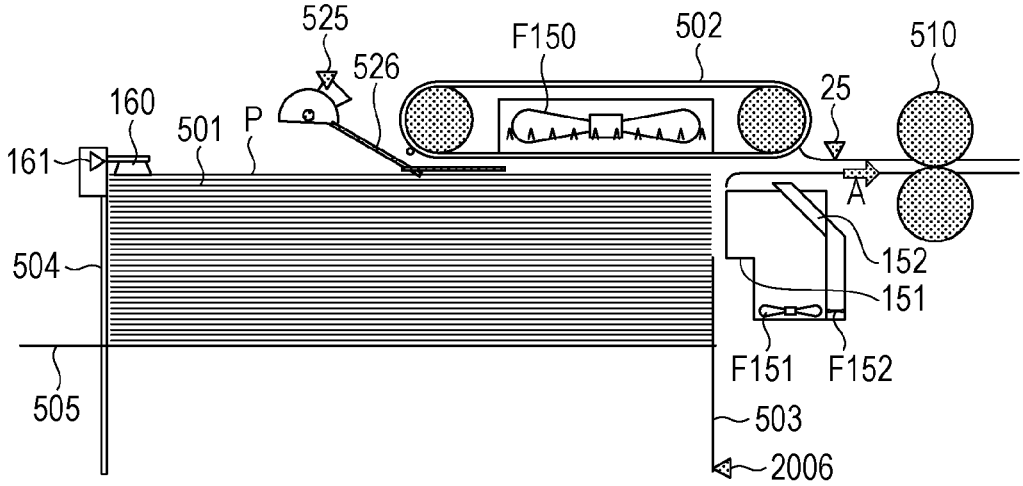
FIGS. 2A and 2B are explanatory views of a sheet container.

As illustrated in FIG. 2A, an upper surface of a top sheet P in the sheet bundle 501 is detected by the sheet-surface detection sensor 525. Due to an operation of lifting lifters of a feed unit and an operation of loosening sheets (described later) performed on the sheet bundle 501 by a vacuum separation mechanism 151, a sheet-surface detection member 526 is lifted together with the top sheet P. A sensor flag of the sheet-surface detection member 526 is thereby moved, and the sheet-surface detection sensor 525 detects the sheet surface.

The trailing-edge detection member 160 is provided on an upper end of the trailing-edge guide 504 and at a position corresponding to the trailing edge of the sheet bundle 501, the trailing-edge detection member 160 being lifted due to lifting of the sheets. When the trailing-edge detection member 160 is lifted due to the lifting of the trailing edge of the sheet bundle 501, a trailing-edge sensor 161 detects the lifting of the trailing-edge detection member 160. This state indicates that the trailing-edge guide 504 and the sheet bundle 501 are properly in contact with each other. In other words, this state indicates that the trailing-edge guide 504 is properly positioned with respect to the sheet bundle 501.

Figure 2B:
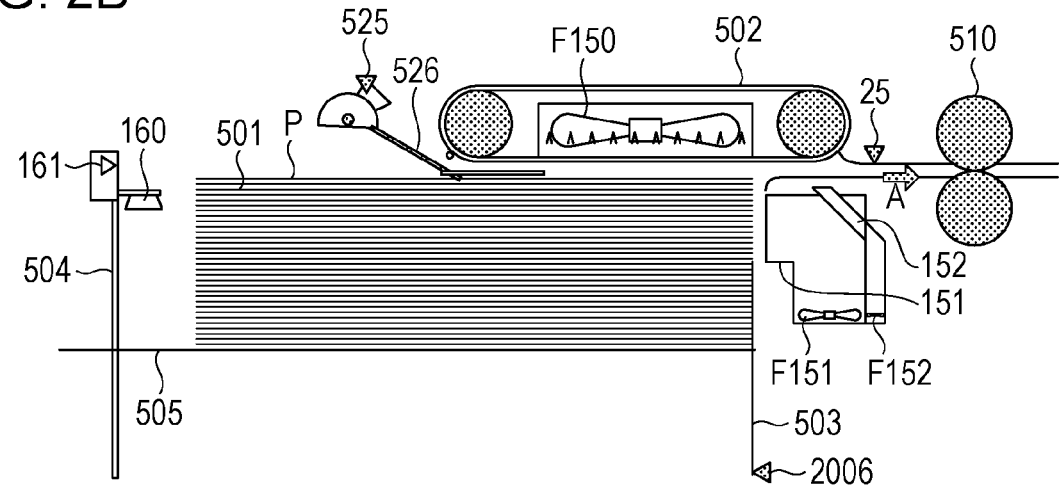

In contrast, a description is given of a case where the trailing-edge guide 504 is not properly positioned at the trailing edge of the sheet bundle 501, as illustrated in FIG. 2B. FIG. 2B illustrates a state in which the sheet-surface detection sensor 525 detects the upper surface of the top sheet P of the sheet bundle 501. Accordingly, the state would otherwise be a state in which the sheet bundle 501 is properly located to cause the trailing-edge detection member 160 to be lifted. However, in this state, although the sheet-surface detection sensor 525 detects the sheet surface, the trailing-edge detection member 160 is not lifted, as described above. This state indicates that the trailing-edge guide 504 is not properly positioned with respect to the sheet bundle 501. Specifically, whether the trailing-edge guide 504 is positioned on the end face of the sheet bundle 501 on the trailing edge side is determined on the basis of a result of detection performed by the trailing-edge sensor 161 performed when the lifted sheet bundle 501 reaches the position at which the sheet surface is detected by the sheet-surface detection sensor 525.

Figure 9:
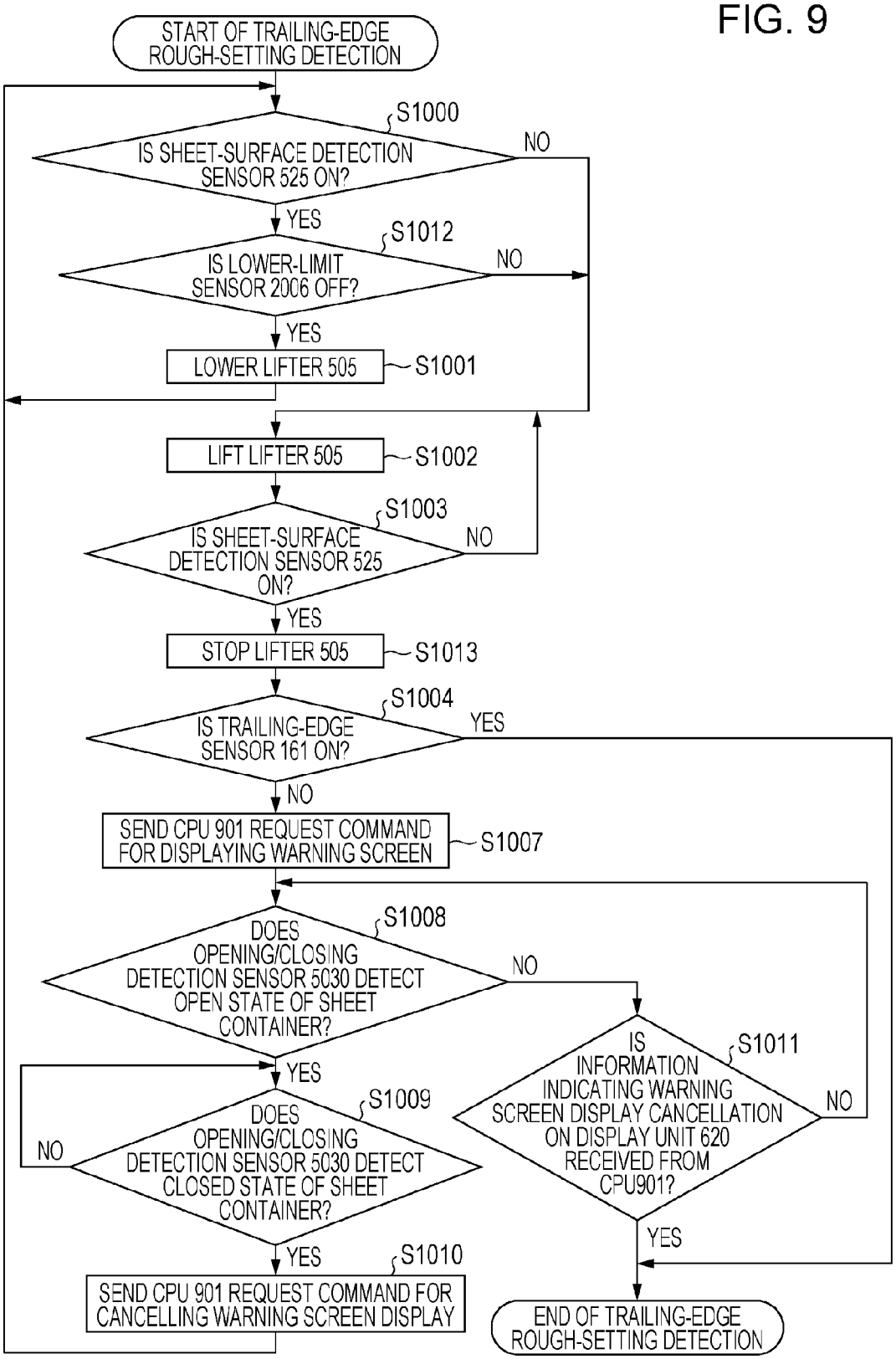
FIG. 9 is a flowchart illustrating trailing-edge rough-setting detection processing.
Figure 10:
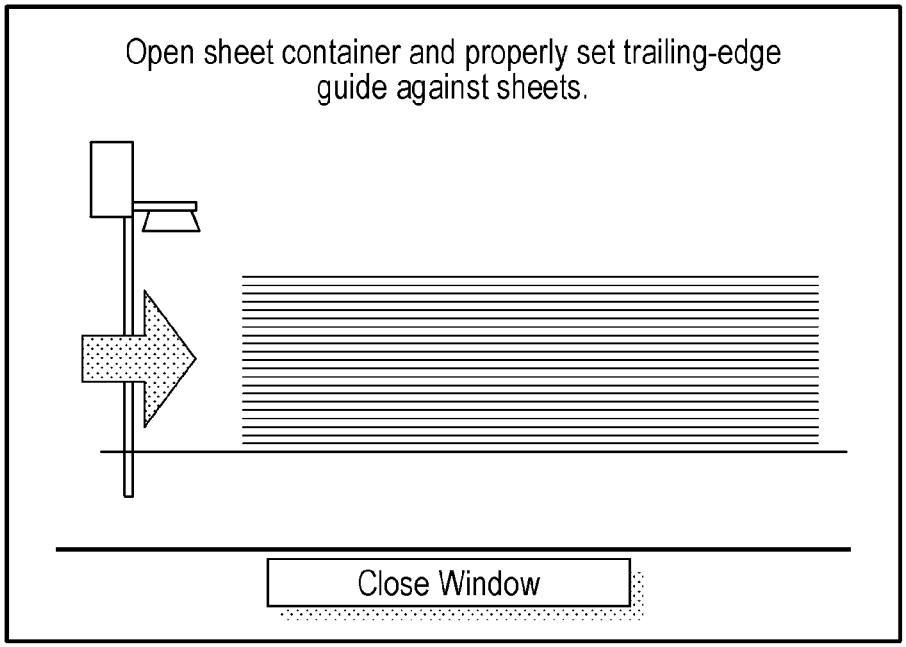
FIG. 10 is an explanatory view of a warning display screen.

The rough-setting detection operation performed by the trailing-edge guide 504 in the sheet container 503 will be described by using a flowchart in FIG. 9 and by using FIG. 10. The CPU 950 of the sheet-feeding-apparatus controller 951 executes processing operations illustrated in FIGS. 9 and 10.

In S1000 and S1012, the CPU 950 determines whether the sheet-surface detection sensor 525 of a sheet container is ON and whether the lower-limit sensor 2006 is OFF (S1000 and S1012). If the CPU 950 determines that the sheet-surface detection sensor 525 is ON and that the lower-limit sensor 2006 is OFF, the CPU 950 causes a lifter motor M205 to lower the lifter 505, so that the sheet bundle 501 is lowered until the sheet-surface detection sensor 525 becomes OFF (S1001). If the sheet-surface detection sensor 525 is OFF, the CPU 950 lifts the lifter 505 until the sheet-surface detection sensor 525 becomes ON (S1002 and S1003).

Figure 3B:
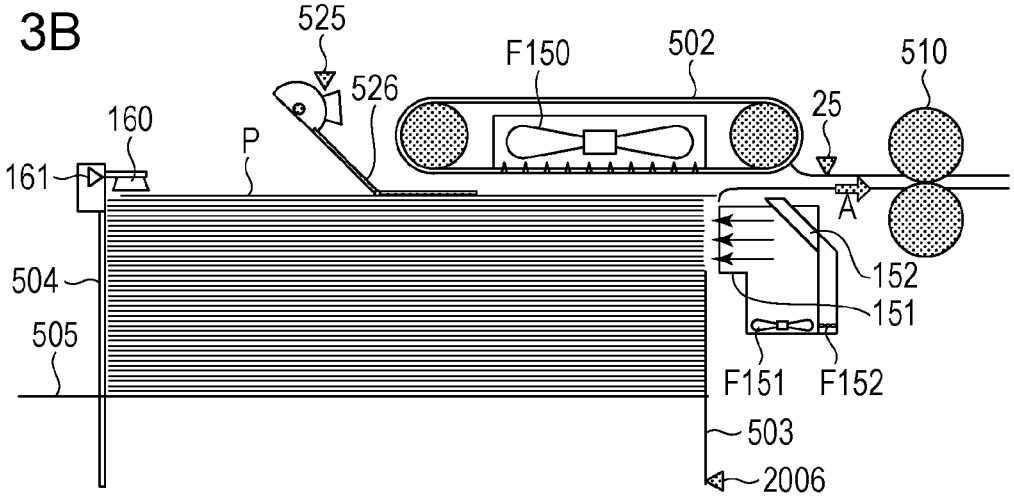
Figure 3C:
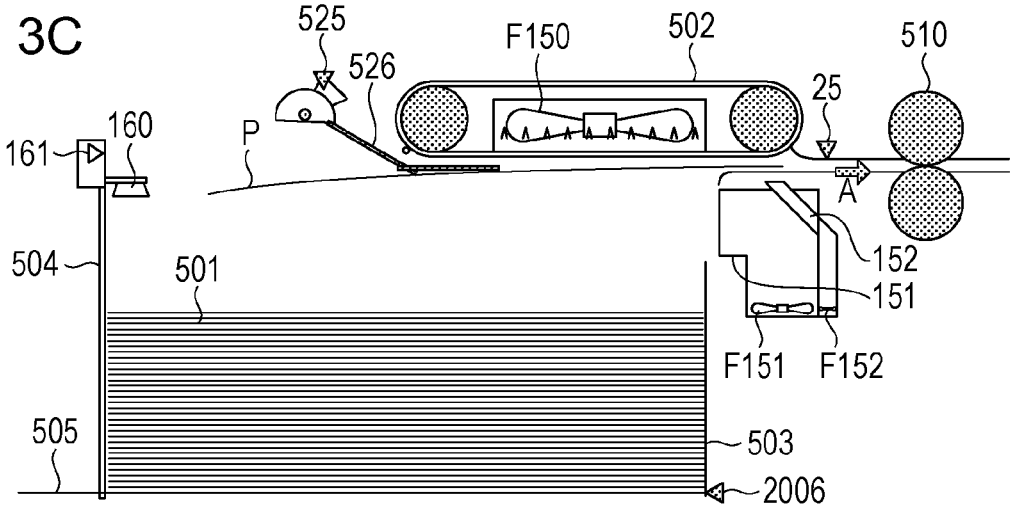

If the sheet-surface detection sensor 525 is ON and if the lower-limit sensor 2006 is ON, the top sheet P and the sheet bundle 501 are assumed to be in the state in FIG. 3C. However, the lifter 505 is not lifted in this case, because the sheet-surface detection sensor 525 has already become ON. If the sheet-surface detection sensor 525 is ON in S1003, the CPU 950 stops lifting the lifter 505. Next, the CPU 950 determines whether the trailing-edge sensor 161 is ON (S1004). If the trailing-edge sensor 161 is ON in S1004, this means that the trailing-edge guide 504 is properly positioned on the trailing edge of the sheet bundle 501, and thus the trailing-edge rough-setting detection processing is terminated.

On the other hand, if the trailing-edge sensor 161 is OFF in S1004, this means that the trailing-edge guide 504 is not properly positioned. The CPU 950 thus sends the CPU 901 a request command for displaying a warning screen (S1007). FIG. 10 illustrates an example of the warning screen.

The CPU 950 determines whether an opening/closing detection sensor 5030 detects an open state of the door of the sheet container 503 (S1008). Until the door is opened, the CPU 950 repeats determining whether status information indicating that the user cancels the warning display on the display unit 620 is received from the CPU 901 (S1011). When the user presses the "Close Window" button in the warning display indicating the message in FIG. 10, the CPU 901 causes the warning display to disappear, recalls the initial screen in FIG. 7A, and notifies the CPU 950 of the status information. In the case where the user presses the "Close Window" button in a state where the trailing-edge guide 504 is not properly positioned in the sheet bundle 501, the trailing-edge rough-setting detection processing is terminated.

If the CPU 950 determines in S1008 that the door of the sheet container 503 is opened on the basis of the output from the opening/closing detection sensor 5030, the CPU 950 determines whether the door is closed on the basis of the output from the opening/closing detection sensor 5030 (S1009). If the CPU 950 determines in S1009 that the door is closed, the CPU 950 sends the CPU 901 a request command for cancelling the warning display on the display unit 620 through a communication unit (not illustrated) (S1010) and returns to the processing in S1000. When receiving the command, the CPU 901 changes the screen on the display unit 620 back to the initial screen in FIG. 7A.

Figure 14:
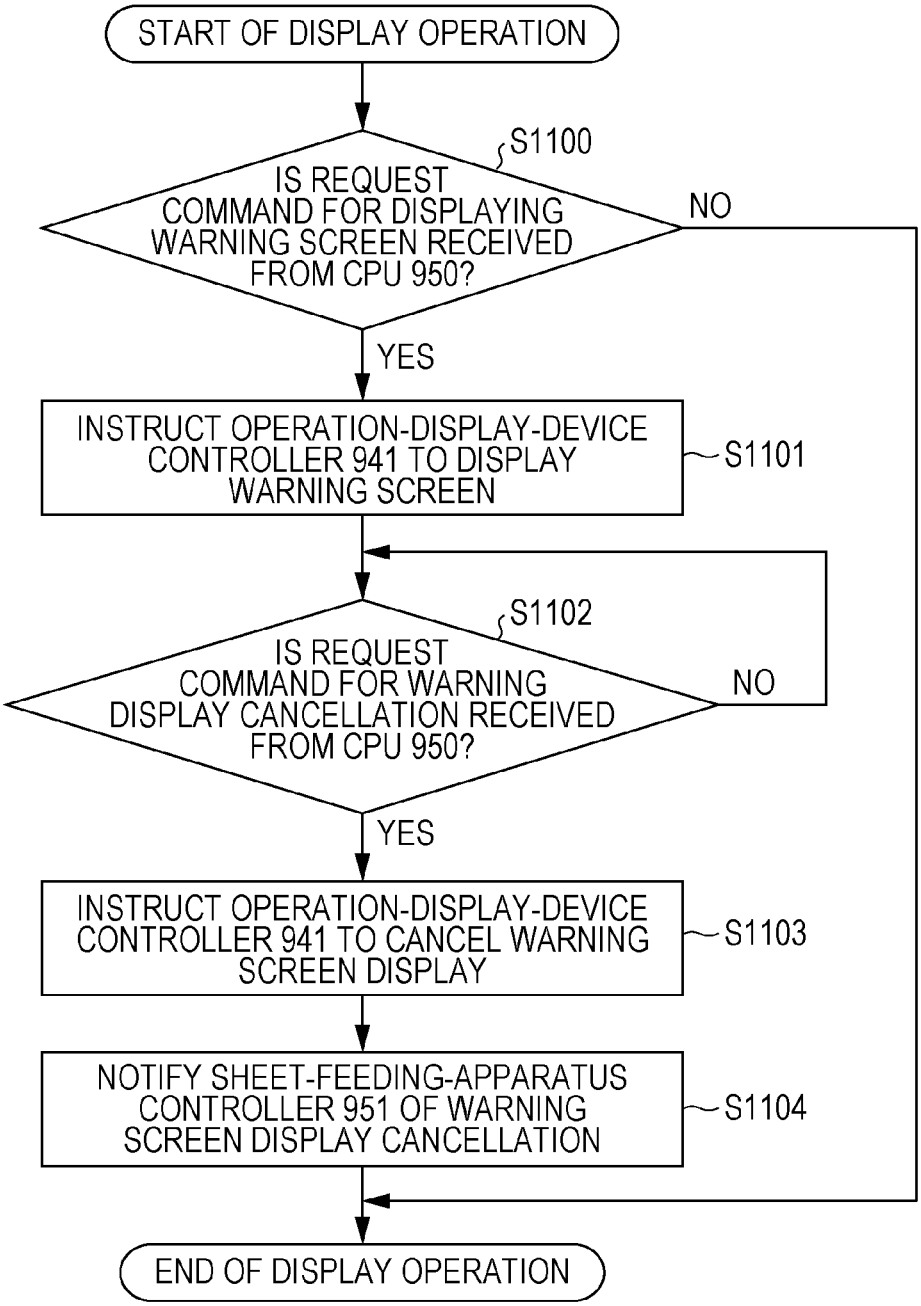
FIG. 14 is a flowchart illustrating control of trailing-edge rough-setting detection display.

Next, display control performed in the trailing-edge rough-setting detection will be described by using a flowchart in FIG. 14. The CPU 901 regularly executes the display control processing at predetermined intervals.

The CPU 901 determines whether the request command for displaying the warning screen is received from the CPU 950 of the sheet-feeding-apparatus controller 951 (S1100). Upon receipt of the command, the CPU 901 sends the operation-display-device controller 941 a request for displaying the warning screen through the communication unit (not illustrated) (S1101). This causes the display unit 620 to display the screen in FIG. 10.

The CPU 901 waits until the CPU 901 receives a request command for cancelling the warning screen display from the CPU 950 (S1102). Upon receipt of the request command for cancelling the warning screen display, the CPU 901 notifies the operation-display-device controller 941 of the request for cancelling the warning screen display (S1103) and also notifies the CPU 950 of the warning screen display cancellation on the display unit 620 (S1104).

The display control flow in the trailing-edge rough-setting detection processing has heretofore been described. As described above, unless the user intentionally cancels the warning display on the display unit 620, the trailing-edge rough-setting detection processing is repeated until the trailing-edge guide 504 is properly placed against the sheet bundle 501.

Although the sheet feeding apparatus 2 performs the trailing-edge rough-setting detection in the foregoing description, the image forming apparatus 10 may also perform the same trailing-edge rough-setting detection processing for the upper cassette 114 or the lower cassette 115. In this case, the CPU 901 or the printer controller 931 performs the foregoing trailing-edge rough-setting detection processing.

If the vacuum separation mechanism 151 of the sheet feeding apparatus 2 repeats the loosening operation without feeding the top sheet P of the sheet bundle 501, the top sheet P gradually proceeds in the conveying direction. This might result in the situation, as illustrated in FIG. 3C, in which the trailing edge of the top sheet P is up in the air in a state where the leading edge of the top sheet P is held in the paper feed path. The situation will be described by using FIGS. 3A to 3C and the flowchart in FIG. 9.

As illustrated in FIG. 3A, the loosening fan F151 rotates in the preparatory feed operation, the loosening nozzle 151 blows air, and sheets including the top sheet P in the upper portion of the sheet bundle 501 are loosened. At this time, the top sheet P of the sheet bundle 501 is blown upward due to the wind force of the air from the loosening nozzle 151, but the trailing edge of the top sheet P is prevented from being lifted, due to operation of the trailing-edge detection member 160. As a result, the top sheet P bends due to the air and the trailing-edge detection member 160. In this state, the top sheet P is to be fed. However, if the feeding of the top sheet P is stopped for some reason such as interruption of a job, the loosening fan F151 is stopped, and thus the preparatory feed operation is terminated. At this time, as illustrated in FIG. 3B, the top sheet P lifted due to the air force is lowered and deposited again on the sheet bundle 501. However, the top sheet P is shifted forward in the conveying direction by an amount corresponding to the bent portion formed due to the air and the trailing-edge detection member 160. In this state, the sheet-surface detection sensor 525 is still OFF. However, if the loosening operation and the stopping of the feed operation are repeated, the leading edge of the top sheet P is drawn into the paper feed path finally, as illustrated in FIG. 3C. Even though the loosening fan F151 is stopped, the top sheet P is up in the air.

At this time, the sheet-surface detection sensor 525 becomes ON, incorrectly detecting the top sheet P drawn in the paper feed path, as the uppermost sheet surface of the sheet bundle 501. If the trailing-edge rough-setting detection is performed in this state, it is determined that the sheet-surface detection sensor 525 of the sheet container 503 is ON, and thus the lifter 505 is lowered (S1001 in FIG. 9). However, the top sheet P has been drawn in the paper feed path. Even though the lifter 505 is lowered, the sheet-surface detection sensor 525 of the sheet container 503 does not become OFF. Since the lifter 505 is lowered until the lower-limit sensor 2006 becomes ON, the leading edge of the top sheet P is held in the paper feed path as illustrated in FIG. 3C, and the top sheet P is consequently up in the air. Since the sheet bundle 501 is located at a lower position at this time, the trailing-edge detection member 160 is not in contact with the sheet bundle 501. If the state as in FIG. 3C occurs, it is determined that the trailing-edge guide 504 is not properly positioned. However, actually the trailing-edge guide 504 is properly positioned in contact with the sheet bundle 501.

The determination as to whether to perform the trailing-edge rough-setting detection operation after completion of a job will be described by using a flowchart in FIG. 11.

Firstly, if the start key 602 for starting the image forming is pressed, the CPU 950 receives, from the CPU 901, job setting information including information regarding a sheet container to be used and a job start command (S2000). Upon receipt of the job start command, the CPU 950 starts the preparatory feed operation for the foregoing sheet container on the basis of the details regarding the acquired job (S2002). Specifically, air is blown from the loosening nozzle 151, and the loosening operation is performed on a sheet bundle. Here, to perform the preparatory feed operation on the sheet container selected in FIG. 7B and all of the sheet containers set in the processing list in FIG. 8D, the CPU 950 determines whether to use a sheet container other than the container having the sheet bundle having undergone the preparatory feed operation (S2003).

When the preparatory feed operations are completed for all of the one or more sheet containers determined to be used for the job, the CPU 950 causes the suction fan F150 to execute a suction operation and causes the suction belt 502, the drawing roller pair 510, and downstream conveyance rollers to execute feeding and conveying of sheets (S2005). The CPU 950 determines whether double feed occurs in the case of the fed sheets by using the double-feed detection sensor 700 (S2006). If the CPU 950 determines that double feed has occurred, the CPU 950 stores, in the RAM 1951, feed information indicating the sheet container from which the double-fed sheets have been fed (S2007).

If the CPU 950 determines that double feed has not occurred, the CPU 950 determines whether the CPU 950 has been notified of an operation termination command from the CPU 901 (S2008). The operation termination command is sent from the CPU 901 at such a time as when a print job is completed and when a print job is stopped due to a sheet jam, a sheet shortage, toner shortage, or a job stop instruction from a user. The CPU 950 repeats feeding and conveying a necessary number of sheets and determining whether double feed occurs, until the CPU 950 receives the operation termination command.

Upon receipt of the operation termination command, the CPU 950 sets 3 to a variable×indicating a sheet container and determines whether to perform the trailing-edge rough-setting detection on the sheet container X. The sheet container X corresponds to a sheet container having an air feed function, the sheet container X in the case of X=3 corresponds to the sheet container 303, and the sheet container X in the case of X=4 corresponds to the sheet container 503.

The CPU 950 determines whether the sheet container X has undergone the preparatory feed operation (S2010). If the CPU 950 determines in S2010 that the sheet container X has undergone the preparatory feed operation, the CPU 950 determines whether double feed has occurred in the case of the sheets fed from the sheet container on the basis of the double feed information stored in the RAM 1951 (S2011).

If the CPU 950 determines in S2011 that double feed has occurred in the case of the sheets fed from the sheet container X, the CPU 950 executes the trailing-edge rough-setting detection processing on the sheet container X (S2013). The CPU 950 determines whether the determination of whether to perform the trailing-edge rough-setting detection has been completed for all of the sheet containers (S2014). If the determination has been completed, the CPU 950 clears the double feed data stored in the RAM 1951 (S2015) and terminates the processing. If the CPU 950 determines in S2014 that the determination has not been completed, the CPU 950 increments the variable X by one (S2012), and executes the same processing on the sheet container.

Meanwhile, if the CPU 950 determines in S2010 that the sheet container X has not undergone the preparatory feed operation, the CPU 950 skips the execution of the trailing-edge rough-setting detection processing to execute the processing in S2014 and subsequent steps. Likewise, if the CPU 950 determines in S2011 that double feed has not occurred in the case of the sheets fed from the sheet container X, the CPU 950 skips the execution of the trailing-edge rough-setting detection processing to execute the processing in S2014 and subsequent steps.

As described above, the trailing-edge rough-setting detection is not executed for a sheet container in which double feed has not occurred, and is executed for a sheet container in which double feed has occurred. The following describes why the trailing-edge rough-setting detection is performed on only a sheet container having double feed. There is a relationship between the trailing-edge rough-setting and occurrence of double feed.

As illustrated in FIG. 3A, if the trailing-edge guide 504 is properly placed against the trailing edge of a sheet bundle, the sheets are properly loosened in the preparatory feed operation including the loosening operation. However, if the preparatory feed operation including the loosening operation is performed in a state where the trailing-edge guide 504 is not properly placed against the trailing edge of the sheet bundle, the sheets are not properly loosened. As a result, two or more overlapping sheets are highly likely to be fed at the same time.

As described above, the trailing-edge rough-setting detection processing is performed on only the sheet container in which the trailing-edge guide 504 might not have been properly placed against the trailing edge of the sheet bundle, and thus a system down time involved in detection processing can be minimized.

Second Embodiment

Figure 12:
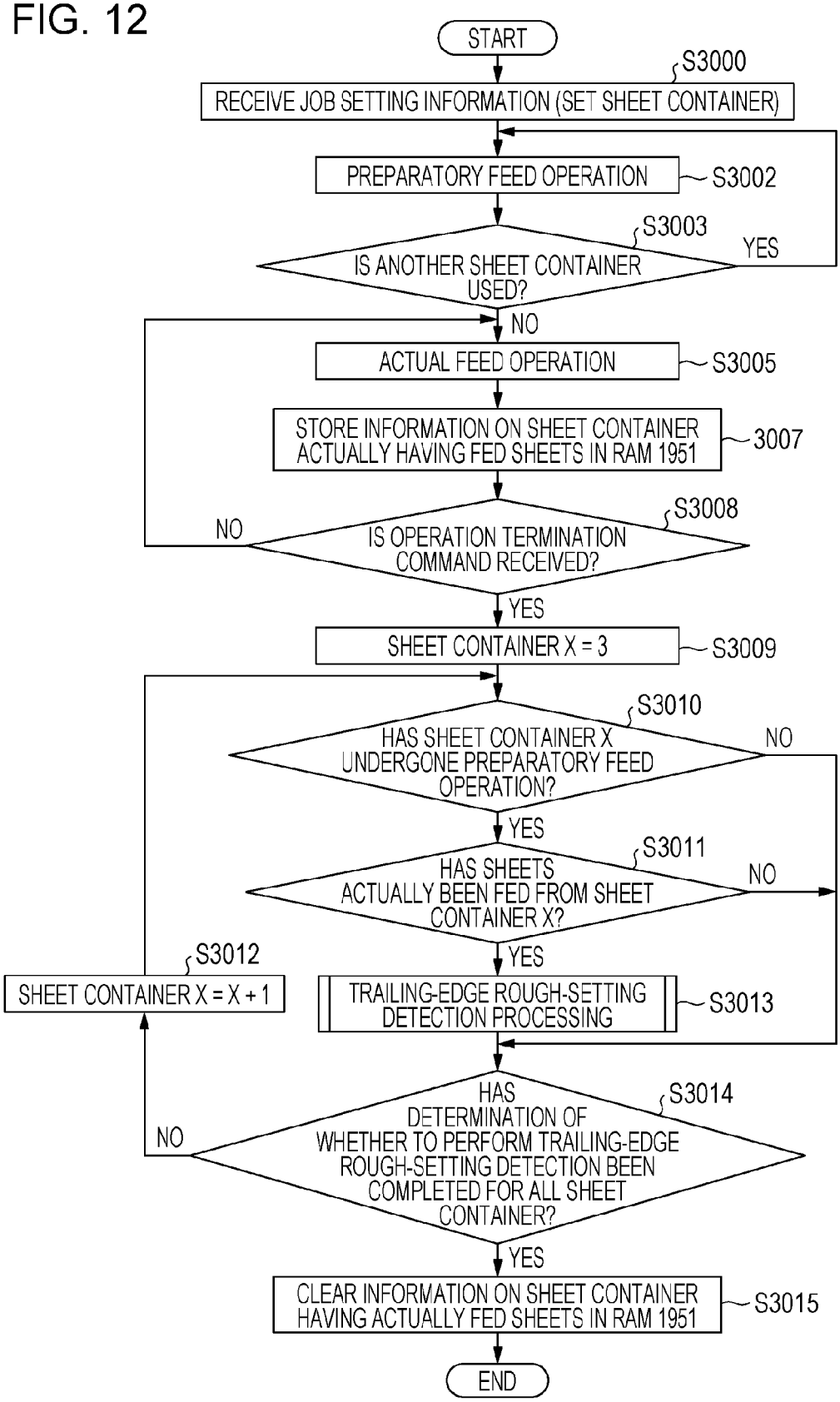
FIG. 12 is a flowchart illustrating determination of whether to execute a trailing-edge rough-setting detection operation in a second embodiment.

Determination of whether to perform the trailing-edge rough-setting detection operation in a second embodiment will be described by using a flowchart in FIG. 12.

In the first embodiment, whether to perform the trailing-edge rough-setting detection is determined on the basis of the determination of whether double feed occurs. In the second embodiment, processing of determining whether to perform the trailing-edge rough-setting detection is performed on the basis of the determination of whether sheets have actually been fed from a sheet container, instead of determining whether double feed occurs.

Figure 11:
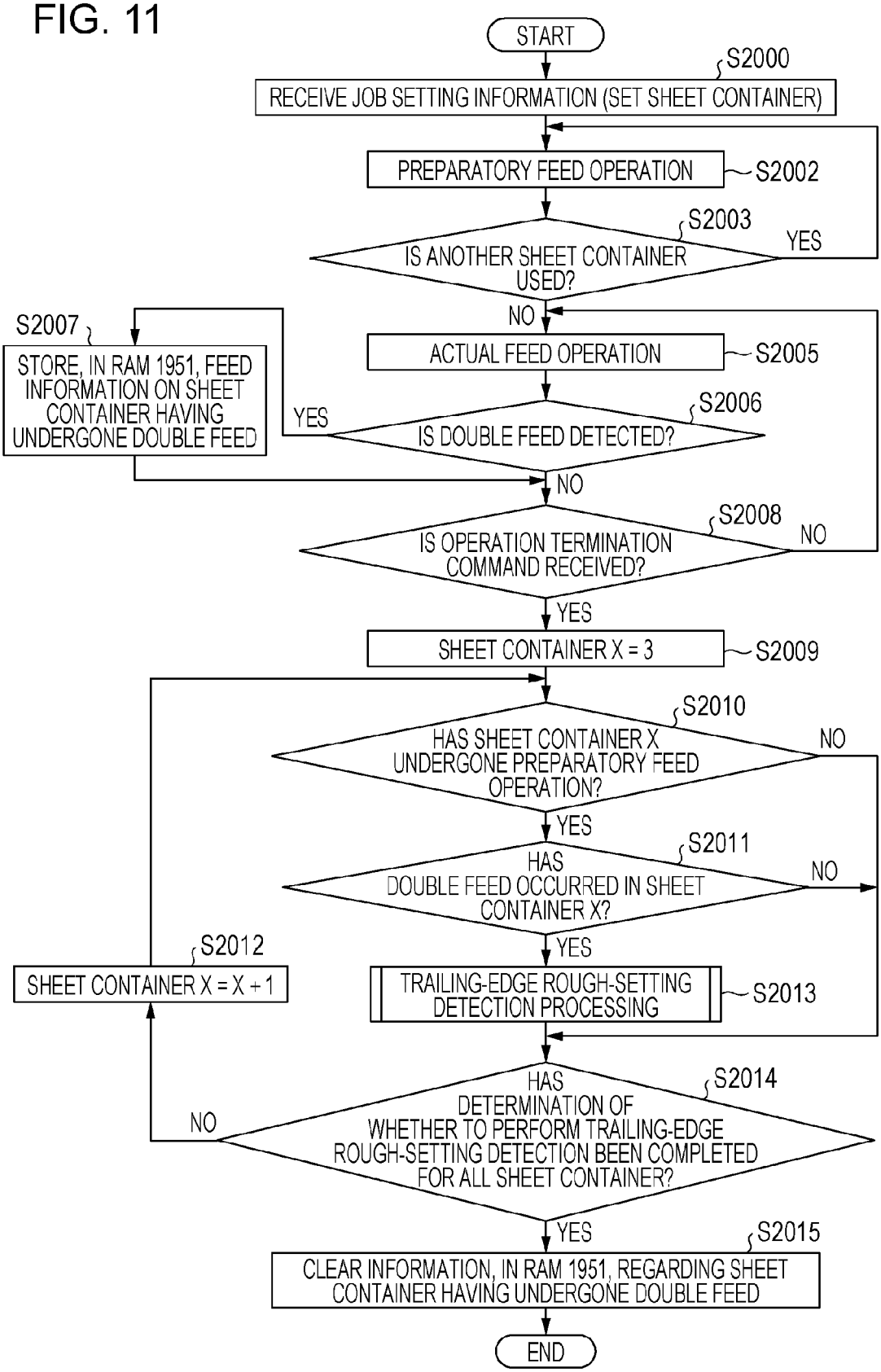
FIG. 11 is a flowchart illustrating determination of whether to execute a trailing-edge rough-setting detection operation.

The same processing as in steps from S2000 to S2005 in FIG. 11 is performed in steps from S3000 to S3005, and thus a description of the processing is omitted. If the sheets have been fed in S3005, the CPU 950 stores, in the RAM 1951, feed information indicating the sheet container from which sheets have been actually fed (S3007). The same processing as in steps from S2008 to S2010 in FIG. 11 is performed in subsequent steps from S3008 to S3010, and thus a description of the processing is omitted.

If the CPU 950 determines in S3010 that the sheet container X is the sheet container having undergone the preparatory feed operation, the CPU 950 determines whether the sheets have been actually fed from the sheet container X on the basis of the feed information stored in the RAM 1951 (S3011). If the CPU 950 determines in S3011 that the sheets have been actually fed from the sheet container X, the CPU 950 performs the trailing-edge rough-setting detection processing (S3013). Then, in the same manner as in S2014, the CPU 950 determines whether the determination of whether to perform the trailing-edge rough-setting detection has been completed for all of the sheet containers (S3014). If the CPU 950 determines in S3014 that the determination has not been completed, the CPU 950 increments the variable X by one (S3012) to perform the same processing for another sheet container. If the CPU 950 determines in S3014 that the determination has been completed, the CPU 950 clears the feed information stored in the RAM 1951 (S3015) and terminates the processing.

Meanwhile, if the CPU 950 determines in S3010 that the sheet container X has not undergone the preparatory feed operation, the CPU 950 skips the trailing-edge rough-setting detection processing to execute the processing in S3014 and subsequent steps. Likewise, if the CPU 950 determines in S3011 that the sheets have not been actually fed from the sheet container X, the CPU 950 skips the trailing-edge rough-setting detection processing to execute the processing in S3014 and subsequent steps.

As described above, the trailing-edge rough-setting detection is not performed on a sheet container from which sheets have not been actually fed. The following describes why the trailing-edge rough-setting detection is performed on only the sheet container from which sheets have been actually fed.

If the preparatory feed operation is repeated in a state where the top sheet P is not fed, the leading edge of the top sheet P in the sheet container might be drawn into the paper feed path, and thus the trailing edge of the top sheet P might be up in the air, as illustrated in FIG. 3C. If the trailing-edge rough-setting detection is performed in this state, a false detection might occur in the determination of whether the trailing-edge guide is properly placed against the sheet bundle, as described above. If the trailing-edge rough-setting detection is not performed on a sheet container from which sheets have not been actually fed, the false detection in the trailing-edge rough-setting detection can be prevented.

Third Embodiment

Figure 13:
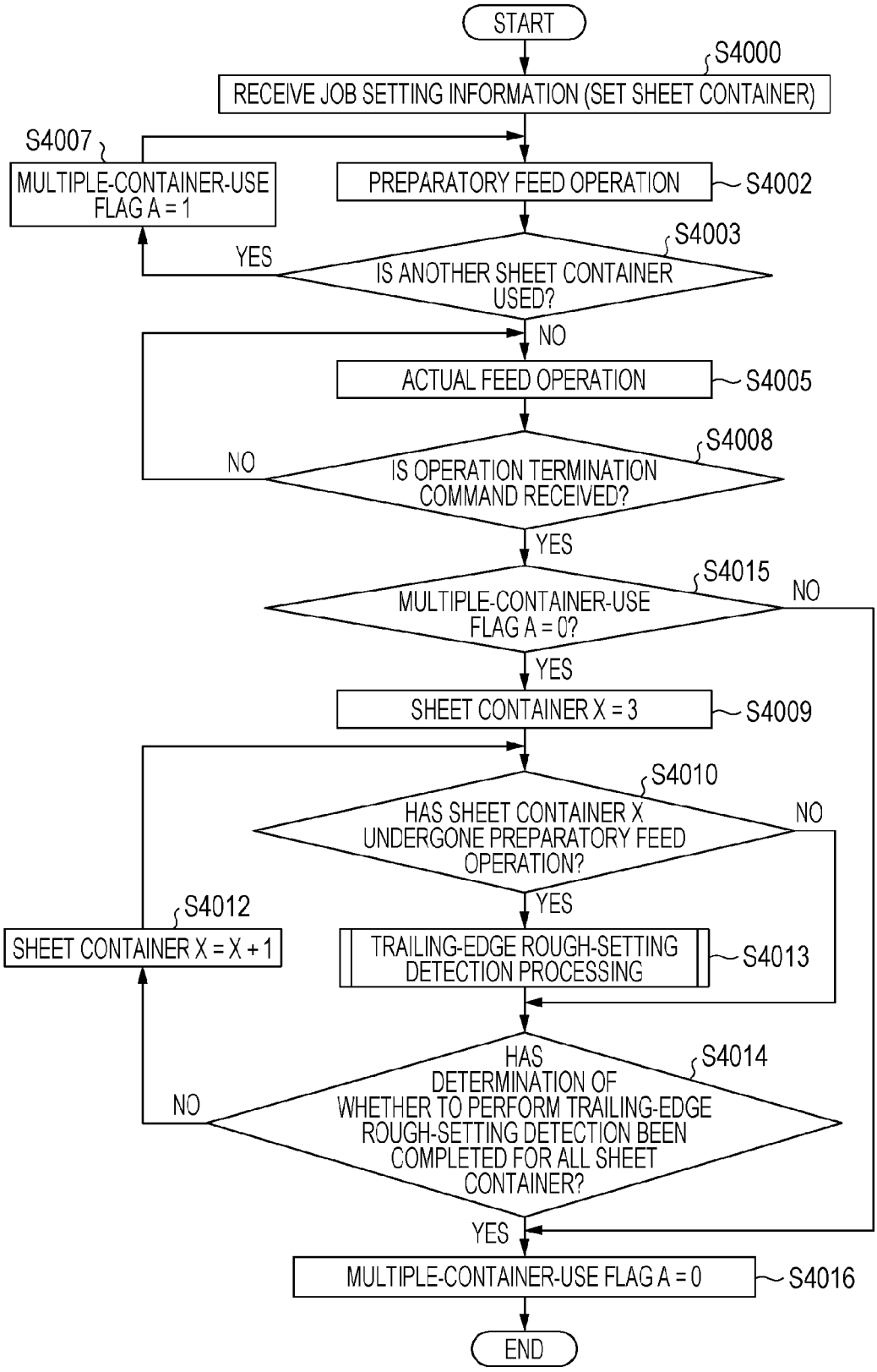
FIG. 13 is a flowchart illustrating determination of whether to execute a trailing-edge rough-setting detection operation in a third embodiment.

Determination of whether to perform the trailing-edge rough-setting detection operation in a third embodiment will be described by using a flowchart in FIG. 13.

Whether to perform the trailing-edge rough-setting detection is determined on the basis of the determination of whether double feed occurs in the first embodiment, and is determined on the basis of the determination of whether sheets have been actually fed in the second embodiment. In the third embodiment, whether to perform the trailing-edge rough-setting detection is determined on the basis of the determination of whether a plurality of sheet containers have been used.

The same processing as in steps from S2000 to S2005 in FIG. 11 is performed in steps from S4000 to S4003, and thus a description of the processing is omitted. If the CPU 950 determines in S4003 that another sheet container is to be used, the CPU 950 sets a flag A to 1 and performs the preparatory feed operation on the other sheet container to be used, the flag A indicating whether a plurality of sheet containers are to be used (S4007). After the preparatory feed operation is performed on all of the to-be-used sheet containers, the CPU 950 executes processing in S4005 and in S4008. The same processing as in S2005 and in S2008 in FIG. 11 is performed in S4005 and in S4008, respectively, and thus a description of the processing is omitted.

If the CPU 950 determines in S4008 that the CPU 950 has received an operation termination command, the CPU 950 determines whether the flag A is 0 (S4015). If A=1, that is, if a plurality of sheet containers are to be used, the CPU 950 skips the trailing-edge rough-setting detection and terminates the processing. If A=0, that is, if only one sheet container is to be used, the CPU 950 sets X=3 in the same manner as in S2009 (S4009). Then, in the same manner as in S2010, the CPU 950 determines whether the sheet container X has undergone the preparatory feed operation (S4010). If the CPU 950 determines that the sheet container X has undergone the preparatory feed operation, the CPU 950 performs the trailing-edge rough-setting detection processing (S4013). Then, in the same manner as in S2014, the CPU 950 determines whether the determination of whether to perform the trailing-edge rough-setting detection has been completed for all of the sheet containers (S4014). If the CPU 950 determines in S4014 that the determination has not been completed for all of the sheet containers, the CPU 950 increments the variable X by one in the same manner as in S2012 (S4012), and performs the same processing on the other sheet container. If the CPU 950 determines in S4014 that the determination has been completed for all of the sheet containers, the CPU 950 sets (resets) the flag A to 0 (S4016) and terminates the processing. If the CPU 950 determines in S4010 that the sheet container X has not undergone the preparatory feed operation, the CPU 950 executes processing in S4014 and subsequent steps.

As described above, if the preparatory feed operation has been performed on a plurality of sheet containers, the trailing-edge rough-setting detection is not performed on the sheet containers. The following describes why the trailing-edge rough-setting detection is not performed.

In a case of a job in which a plurality of sheet containers are used, sheets might not have actually been fed from a certain sheet container for some reason such as job interruption or sheet shortage of the sheet container, even after the job is stopped. Accordingly, the sheet container on which the preparatory feed operation has been performed but from which sheets have not actually been fed might be in the state as illustrated in FIG. 3C. Specifically, in this state, the trailing edge of the top sheet P having been placed in the sheet container is drawn into the paper feed path and is up in the air. If the trailing-edge rough-setting detection is performed in this state, the false detection might occur in the determination of whether the trailing-edge guide is properly placed against the sheet bundle, as described above. However, in this embodiment, the trailing-edge rough-setting detection is not performed on a plurality of sheet containers on which the preparatory feed operation has been performed and thus is not performed on a sheet container in the state in FIG. 3C. Thus, the false detection can be prevented.

In a case where the image forming apparatus 10 includes such a sheet container having the air feed function as the sheet container 303 or 503, the CPU 901 or the printer controller 931 of the image forming apparatus 10 may execute the foregoing control performed by the CPU 950.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269662, filed Dec. 26, 2013, which is hereby incorporated by reference herein in its entirety.

What is claimed is:

1. A sheet feeding apparatus comprising:

a containing unit that contains a sheet bundle formed of a plurality of sheets;

a lifting and lowering unit that lifts and lowers the sheet bundle contained in the containing unit;

a loosening unit that loosens the plurality of sheets of the sheet bundle contained in the containing unit by blowing air into the sheet bundle;

a feed unit that feeds sheets loosened by the loosening unit;

a sheet-surface detection unit that detects a sheet surface of a top of the sheet bundle contained in the containing unit;

an aligning member that is movable to align an end face of the sheet bundle contained in the containing unit on a trailing-edge side in a direction of feeding performed by the feed unit;

a trailing-edge detection unit that moves together with the aligning member and that detects a sheet surface of the top of the sheet bundle on the trailing-edge side;

a double-feed detection unit that detects occurrence of double feed in which two or more sheets are fed in an overlapping manner by the feed unit; and a control unit that performs control in which, in a case where the double-feed detection unit does not detect double feed from the containing unit, a detection operation is not executed on the containing unit, and in which, in a case where the double-feed detection unit detects double feed from the containing unit, the detection operation is executed on the containing unit such that, as part of performing the detection operation, the detection operation detects whether the aligning member is located at a position at which the end face of the sheet bundle on the trailing-edge side is aligned, wherein the detection operation is performed in consideration of a result of detection performed by the trailing-edge detection unit when the sheet bundle lifted by the lifting and lowering unit reaches a position at which the sheet surface is detected by the sheet-surface detection unit.

2. The sheet feeding apparatus according to claim 1, wherein, in a case where the trailing-edge detection unit detects the sheet surface of the sheet bundle on the trailing-edge side in the detection operation, the control unit determines that the aligning member is located at the position at which the end face of the sheet bundle on the trailing-edge side is aligned, and wherein, in a case where the trailing-edge detection unit does not detect the sheet surface of the sheet bundle on the trailing-edge side, the control unit determines that the aligning member is not located at the position at which the end face of the sheet bundle on the trailing-edge side is aligned.

3. The sheet feeding apparatus according to claim 2, wherein, in a case where the control unit determines that the aligning member is not located at the position at which the end face of the sheet bundle on the trailing-edge side is aligned, the control unit provides a warning indicating that the aligning member is not located appropriately.

4. The sheet feeding apparatus according to claim 3, further comprising an opening and closing detection unit that detects opening and closing of the containing unit, wherein, in a case where the control unit provides the warning and where the opening and closing detection unit detects opening of the containing unit and closing of the containing unit later, the control unit cancels the provided warning.

5. The sheet feeding apparatus according to claim 2, wherein, in a case where the trailing-edge detection unit does not detect the sheet surface of the sheet bundle on the trailing-edge side in the detection operation, the control unit determines that the aligning member is not located at the position at which the end face of the sheet bundle on the trailing-edge side is aligned.

6. The sheet feeding apparatus according to claim 1, wherein the control unit performs control in which the detection operation is not executed on the containing unit on which the loosening unit has not executed a loosening operation.

7. The sheet feeding apparatus according to claim 1, further comprising a storage unit that stores data indicating the containing unit from which the double-feed detection unit detects double feed, wherein the storage unit clears the data after the detection operation has been executed.

8. The sheet feeding apparatus according to claim 1, wherein the control unit executes the detection operation after a print job is completed or has been interrupted.

9. A sheet feeding apparatus comprising:

a containing unit that contains a sheet bundle formed of a plurality of sheets;

a lifting and lowering unit that lifts and lowers the sheet bundle contained in the containing unit;

a loosening unit that loosens the plurality of sheets of the sheet bundle contained in the containing unit by blowing air into the sheet bundle;

a feed unit that feeds sheets loosened by the loosening unit;

a sheet-surface detection unit that detects a sheet surface of a top of the sheet bundle contained in the containing unit;

an aligning member that is movable to align an end face of the sheet bundle contained in the containing unit on a trailing-edge side in a direction of feeding performed by the feed unit;

a trailing-edge detection unit that moves together with the aligning member and that detects a sheet surface of the top of the sheet bundle on the trailing-edge side; and a control unit that performs control in which, in a case where the loosening unit has performed a loosening operation but the feed unit has not actually fed the sheets from the containing unit, a detection operation is not executed on the containing unit, and in which, in a case where the feed unit has actually fed the sheets from the containing unit, the detection operation is executed on the containing unit such that, as part of performing the detection operation, the detection operation detects whether the aligning member is located at a position at which the end face of the sheet bundle on the trailing-edge side is aligned, wherein the detection operation is performed in consideration of a result of detection performed by the trailing-edge detection unit when the sheet bundle lifted by the lifting and lowering unit reaches a position at which the sheet surface is detected by the sheet-surface detection unit.

10. The sheet feeding apparatus according to claim 9, wherein, in a case where the trailing-edge detection unit detects the sheet surface of the sheet bundle on the trailing-edge side in the detection operation, the control unit determines that the aligning member is located at the position at which the end face of the sheet bundle on the trailing-edge side is aligned, and wherein, in a case where the trailing-edge detection unit does not detect the sheet surface of the sheet bundle on the trailing-edge side, the control unit determines that the aligning member is not located at the position at which the end face of the sheet bundle on the trailing-edge side is aligned.

11. The sheet feeding apparatus according to claim 10, wherein, in a case where the control unit determines that the aligning member is not located at the position at which the end face of the sheet bundle on the trailing-edge side is aligned, the control unit provides a warning indicating that the aligning member is not located appropriately.

12. The sheet feeding apparatus according to claim 11, further comprising an opening and closing detection unit that detects opening and closing of the containing unit, wherein, in a case where the control unit provides the warning and where the opening and closing detection unit detects opening of the containing unit and closing of the containing unit later, the control unit cancels the provided warning.

13. The sheet feeding apparatus according to claim 10, wherein, in the case where the trailing-edge detection unit does not detect the sheet surface of the sheet bundle on the trailing-edge side in the detection operation, the control unit determines that the aligning member is not located at the position at which the end face of the sheet bundle on the trailing-edge side is aligned.

14. The sheet feeding apparatus according to claim 9, wherein the control unit performs control in which the detection operation is not executed on the containing unit on which the loosening unit has not executed the loosening operation.

15. The sheet feeding apparatus according to claim 9, further comprising a storage unit that stores data indicating the containing unit from which the feed unit has actually fed the sheets, wherein the storage unit clears the data after the detection operation has been executed.

16. The sheet feeding apparatus according to claim 9, wherein the control unit executes the detection operation after a print job is completed or has been interrupted.

17. A sheet feeding apparatus comprising:

a plurality of containing units that each contain a sheet bundle formed of a plurality of sheets;

lifting and lowering units that each lift and lower the sheet bundle contained in a corresponding one of the plurality of containing units;

loosening units that each loosen the plurality of sheets of the sheet bundle contained in the corresponding one of the plurality of containing units by blowing air into the sheet bundle;

feed units that each feed sheets loosened by a corresponding one of the loosening units;

sheet-surface detection units that each detect a sheet surface of a top of the sheet bundle contained in the corresponding one of the plurality of containing units;

aligning members that are each movable to align an end face of the sheet bundle contained in the corresponding one of the plurality of containing units on a trailing-edge side in a direction of feeding performed by a corresponding one of the feed units;

trailing-edge detection units that each move together with a corresponding one of the aligning members and that each detect a sheet surface of the top of the sheet bundle on the trailing-edge side; and a control unit that performs control in which, in a case where the sheets are to be fed from the plurality of containing units in accordance with a print job, a detection operation is not executed on the plurality of containing units, and in which, in a case where the sheets are not to be fed from the plurality of containing units in accordance with the print job, the detection operation is executed on the plurality of containing units such that, as part of performing the detection operation, the detection operation detects whether a corresponding one of the aligning members is located at a position at which the end face of the sheet bundle on the trailing-edge side is aligned, wherein the detection operation is performed in consideration of a result of detection performed by a corresponding one of the trailing-edge detection units when the sheet bundle lifted by the corresponding one of the lifting and lowering units reaches a position at which the sheet surface is detected by a corresponding one of the sheet-surface detection units.

18. The sheet feeding apparatus according to claim 17, wherein, in a case where the trailing-edge detection unit detects the sheet surface of the sheet bundle on the trailing-edge side in the detection operation, the control unit determines that the aligning member is located at the position at which the end face of the sheet bundle on the trailing-edge side is aligned, and wherein, in a case where the trailing-edge detection unit does not detect the sheet surface of the sheet bundle on the trailing-edge side, the control unit determines that the aligning member is not located at the position at which the end face of the sheet bundle on the trailing-edge side is aligned.

19. The sheet feeding apparatus according to claim 18, wherein, in a case where the control unit determines that the aligning member is not located at the position at which the end face of the sheet bundle on the trailing-edge side is aligned, the control unit provides a warning indicating that the aligning member is not located appropriately.

20. The sheet feeding apparatus according to claim 19, further comprising opening and closing detection units that each detect opening and closing of a corresponding one of the plurality of containing units, wherein, in a case where the control unit provides the warning and where one of the opening and closing detection units detects opening of a corresponding one of the containing units and closing of the containing unit later, the control unit cancels the provided warning.

21. The sheet feeding apparatus according to claim 18, wherein, in the case where the trailing-edge detection unit does not detect the sheet surface of the sheet bundle on the trailing-edge side in the detection operation, the control unit determines that the aligning member is not located at the position at which the end face of the sheet bundle on the trailing-edge side is aligned.

22. The sheet feeding apparatus according to claim 18, wherein the control unit performs control in which the detection operation is not executed on each of the containing units which has not undergone a loosening operation by the corresponding one of the loosening units.

23. The sheet feeding apparatus according to claim 18, further comprising a storage unit that stores data indicating that the sheets are to be fed from the plurality of containing units in accordance with the print job, wherein the storage unit clears the data after the detection operation has been executed.

24. The sheet feeding apparatus according to claim 18, wherein the control unit executes the detection operation after the print job is completed or has been interrupted.

25. An image forming apparatus comprising:

a containing unit that contains a sheet bundle formed of a plurality of sheets;

a lifting and lowering unit that lifts and lowers the sheet bundle contained in the containing unit;

a loosening unit that loosens the plurality of sheets of the sheet bundle contained in the containing unit by blowing air into the sheet bundle;

a feed unit that feeds sheets loosened by the loosening unit;

an image forming unit that forms an image on each of the sheets fed by the feed unit;

a sheet-surface detection unit that detects a sheet surface of a top of the sheet bundle contained in the containing unit;

an aligning member that is movable to align an end face of the sheet bundle contained in the containing unit on a trailing-edge side in a direction of feeding performed by the feed unit;

a trailing-edge detection unit that moves together with the aligning member and that detects a sheet surface of the top of the sheet bundle on the trailing-edge side;

a double-feed detection unit that detects occurrence of double feed in which two or more sheets are fed in an overlapping manner by the feed unit; and a control unit that performs control in which, in a case where the double-feed detection unit does not detect double feed from the containing unit, a detection operation is not executed on the containing unit, and in which, in a case where the double-feed detection unit detects double feed from the containing unit, the detection operation is executed on the containing unit such that, as part of performing the detection operation, the detection operation detects whether the aligning member is located at a position at which the end face of the sheet bundle on the trailing-edge side is aligned, wherein the detection operation is performed in consideration of a result of detection performed by the trailing-edge detection unit when the sheet bundle lifted by the lifting and lowering unit reaches a position at which the sheet surface is detected by the sheet-surface detection unit.

26. An image forming apparatus comprising:

a containing unit that contains a sheet bundle formed of a plurality of sheets;

a lifting and lowering unit that lifts and lowers the sheet bundle contained in the containing unit;

a loosening unit that loosens the plurality of sheets of the sheet bundle contained in the containing unit by blowing air into the sheet bundle;

a feed unit that feeds sheets loosened by the loosening unit;

an image forming unit that forms an image on each of the sheets fed by the feed unit;

a sheet-surface detection unit that detects a sheet surface of a top of the sheet bundle contained in the containing unit;

an aligning member that is movable to align an end face of the sheet bundle contained in the containing unit on a trailing-edge side in a direction of feeding performed by the feed unit;

a trailing-edge detection unit that moves together with the aligning member and that detects a sheet surface of the top of the sheet bundle on the trailing-edge side; and a control unit that performs control in which, in a case where the loosening unit has performed a loosening operation but the feed unit has not actually fed the sheets from the containing unit, a detection operation is not executed on the containing unit, and in which, in a case where the feed unit has actually fed the sheets from the containing unit, the detection operation is executed on the containing unit such that, as part of performing the detection operation, the detection operation detects whether the aligning member is located at a position at which the end face of the sheet bundle on the trailing-edge side is aligned, wherein the detection operation is performed in consideration of a result of detection performed by the trailing-edge detection unit when the sheet bundle lifted by the lifting and lowering unit reaches a position at which the sheet surface is detected by the sheet-surface detection unit.

27. An image forming apparatus comprising:

a plurality of containing units that each contain a sheet bundle formed of a plurality of sheets;

lifting and lowering units that each lift and lower the sheet bundle contained in a corresponding one of the plurality of containing units;

loosening units that each loosen the plurality of sheets of the sheet bundle contained in the corresponding one of the plurality of containing units by blowing air into the sheet bundle;

feed units that each feed sheets loosened by a corresponding one of the loosening units;

an image forming unit that forms an image on each of the sheets fed by the feed unit;

sheet-surface detection units that each detect a sheet surface of a top of the sheet bundle contained in the corresponding one of the plurality of containing units;

aligning members that are each movable to align an end face of the sheet bundle contained in the corresponding one of the plurality of containing units on a trailing-edge side in a direction of feeding performed by a corresponding one of the feed units;

trailing-edge detection units that each move together with a corresponding one of the aligning members and that each detect a sheet surface of the top of the sheet bundle on the trailing-edge side; and a control unit that performs control in which, in a case where the sheets are to be fed from the plurality of containing units in accordance with a print job, a detection operation is not executed on the plurality of containing units, and in which, in a case where the sheets are not to be fed from the plurality of containing units in accordance with the print job, the detection operation is executed on the plurality of containing units such that, as part of performing the detection operation, the detection operation detects whether a corresponding one of the aligning members is located at a position at which the end face of the sheet bundle on the trailing-edge side is aligned, wherein the detection operation is performed in consideration of a result of detection performed by a corresponding one of the trailing-edge detection units when the sheet bundle lifted by the corresponding one of the lifting and lowering units reaches a position at which the sheet surface is detected by a corresponding one of the sheet-surface detection units.

* * * * *